US007290509B2

(12) United States Patent
Lou

(10) Patent No.: US 7,290,509 B2
(45) Date of Patent: Nov. 6, 2007

(54) VARIABLE VALVE ACTUATOR

(76) Inventor: Zheng Lou, 11200 Felloes Creek Dr., Plymouth, MI (US) 48170

( * ) Notice: Subject to any disclaimer, the term of this patent is extended or adjusted under 35 U.S.C. 154(b) by 59 days.

(21) Appl. No.: 11/194,243

(22) Filed: Aug. 1, 2005

(65) Prior Publication Data

US 2007/0022986 A1 Feb. 1, 2007

(51) Int. Cl.
*F01L 9/02* (2006.01)

(52) U.S. Cl. ..... 123/90.12; 251/25; 137/906; 91/508

(58) Field of Classification Search ..... 123/90.12; 137/906; 251/25; 91/356, 292, 508
See application file for complete search history.

(56) References Cited

U.S. PATENT DOCUMENTS

| | | | | |
|---|---|---|---|---|
| 4,930,464 | A | 6/1990 | Letsche | 123/90.12 |
| 5,248,123 | A | 9/1993 | Richeson et al. | 251/29 |
| 5,595,148 | A | 1/1997 | Letsche et al. | 123/90.12 |
| 5,765,515 | A | 6/1998 | Letsche | 123/90.12 |
| 5,809,950 | A | 9/1998 | Letsche et al. | 123/90.12 |
| 6,167,853 | B1 | 1/2001 | Letsche | 123/90.12 |
| 6,491,007 | B1 | 12/2002 | Kubel et al. | 123/90.12 |
| 6,601,552 | B2 | 8/2003 | Kubel et al. | 123/90.12 |
| 2002/0073946 | A1 * | 6/2002 | Lou | 123/90.12 |
| 2004/0055547 | A1 | 3/2004 | Diehl et al. | |

* cited by examiner

*Primary Examiner*—Zelalem Eshete
(74) *Attorney, Agent, or Firm*—Gifford, Krass, Sprinkle, Anderson & Citkowski, PC

(57) ABSTRACT

Improved actuators and valve control systems, and methods for controlling actuators and/or engine valves, are disclosed. In addition to the inherent capability of timing control, the ability to provide continuous valve lift or stroke control greatly improves engine achieve fuel economy, emission and performance. The power-off state of the actuator is at the minimum stroke, from which an easy start-up can be directly executed. The minimum stroke is also very beneficial to achieve efficient low load operation. Even with continuous lift variation, the present invention is able to keep the spring force neutral or zero point in the center of a stroke, thus maintaining an efficient scheme of energy conversion and recovery through the pendulum action. When in compression braking or other high engine cylinder air pressure working mode, the invention is able to supply necessary force to open the engine valve. By adding a substantial hydraulic force to coincide with the spring returning force at the beginning of each stroke, the system can help overcome the engine cylinder air pressure and compensate for frictional losses. The present invention is able to incorporate lash adjustment into all alternative preferred embodiments. It is also possible to trigger and complete one engine valve stroke by just one, instead of two, switch actions of the actuation switch valve.

24 Claims, 13 Drawing Sheets

| Engine Valve Opening | Xev = 0 | Xev < L3 | L3 < Xev < 0.5 ST | Xev = 0.5 ST | 0.5 ST < Xev < ST - L2 | ST - L2 < Xev < ST | Xev = ST |
|---|---|---|---|---|---|---|---|
| Actuation Piston | Overlap with 1st partial cylinder | Overlap with 1st partial cylinder | No overlap with cylinders | No overlap with cylinders | No overlap with cylinders | Overlap with 2nd partial cylinder | Overlap with 2nd partial cylinder |
| Net Spring Force | Maximum, 2nd direction | High, 2nd direction | High-low, 2nd direction | ~ 0 | Low-high, 1st direction | High, 1st direction | Maximum, 1st direction |
| Travel Direction | 2nd Direction ----------> | | | | | | |
| Switch Valve | Right Position | | | | | | |
| 1st Port Pressure | P_H | | | | | | |
| 2nd Port Pressure | P_L | | | | | | |
| 1st Fluid Space Flow | FM1 | FM1 | Bypass | Bypass | Bypass | FM1S | FM1S |
| 2nd Fluid Space Flow | FM2S | FM2S | Bypass | Bypass | Bypass | FM2 | FM2 |
| 1st Fluid Space Pressure | P_H | P_H, lower with starving | About equal pressure in both fluid spaces | | | P_H | P_H |
| 2nd Fluid Space Pressure | P_L | P_L | | | | P_L, higher with snubbing | P_L |
| Net Pressure Force | 2nd Direction | 2nd Direction | ~ 0 | ~ 0 | ~ 0 | Depends | 2nd Direction |
| Total Force or Acceleration | High, 2nd direction | High, 2nd direction | Medium-low, 2nd direction | ~ 0 | Low-medium, 1st direction | Depends, generally in 1st direction | 0 with contact force |
| Velocity | 0 | Low to medium, 2nd direction | Medium to High, 2nd direction | ~ Maximum, 2nd direction | High to Medium, 2nd direction | Medium-low, 2nd direction | 0 |
| Travel Direction | <---------- 1st Direction | | | | | | |
| Switch Valve | Left Position | | | | | | |
| 1st Port Pressure | P_L | | | | | | |
| 2nd Port Pressure | P_H | | | | | | |
| 1st Fluid Space Flow | FM1 | FM1 | Bypass | Bypass | Bypass | FM1S | FM1S |
| 2nd Fluid Space Flow | FM2S | FM2S | Bypass | Bypass | Bypass | FM2 | FM2 |
| 1st Fluid Space Pressure | P_L | P_L, higher with snubbing | About equal pressure in both fluid spaces | | | P_L | P_L |
| 2nd Fluid Space Pressure | P_H | P_H | | | | P_H, lower with starving | P_H |
| Net Pressure Force | 1st Direction | 1st Direction | ~ 0 | ~ 0 | ~ 0 | Depends | 1st Direction |
| Total Force or Acceleration | 0 with contact force | Depends, generally in 2nd direction | Low-medium, 2nd direction | ~ 0 | Medium-low, 1st direction | High, 1st direction | High, 1st direction |
| Velocity | 0 | Medium-low, 1st direction | High-medium, 1st direction | ~ Maximum, 1st direction | Medium-high, 1st direction | Low-medium, 1st direction | 0 |

FIGURE 5

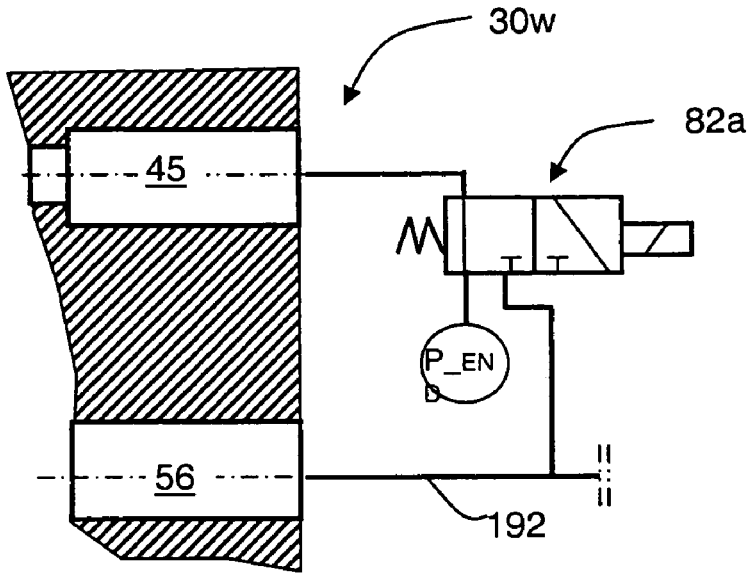
(a)
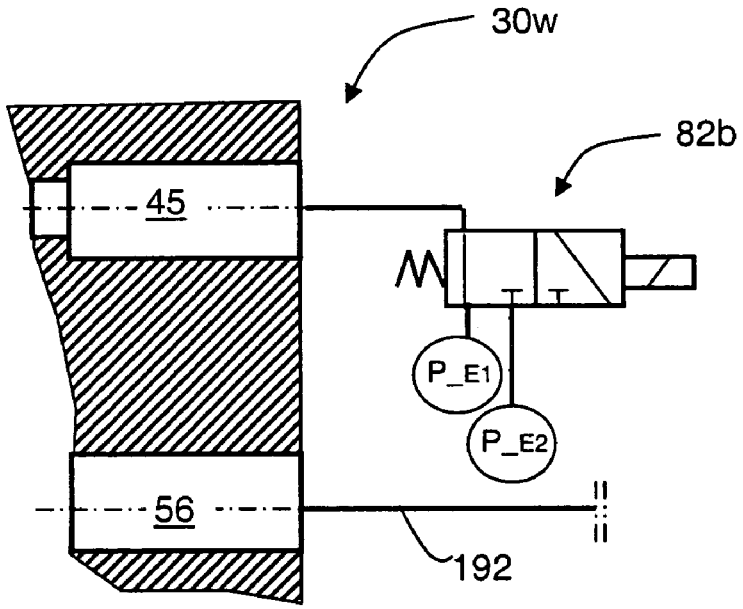
(b)
FIGURE 13

VARIABLE VALVE ACTUATOR

FIELD OF THE INVENTION

This invention relates generally to actuators and corresponding methods and systems for controlling such actuators, and in particular, to actuators providing independent lift (or stroke) and timing control with minimum energy consumption.

BACKGROUND OF THE INVENTION

Various systems can be used to actively control the lift (or stroke) and timing of engine valves to achieve improvements in engine performance, fuel economy, emissions, and other characteristics. Depending on the means of the control or the actuator, these systems can be classified as mechanical, electrohydraulic, and electromechanical (sometimes called electromagnetic). Depending on the extent of the control, they can be classified as variable valve-lift and timing, variable valve-timing, and variable valve-lift. They can also be classified as cam-based or indirect acting and camless or direct acting.

In the case of a cam-based system, the traditional engine cam system is kept and modified somewhat to indirectly adjust valve timing and/or lift. In a camless system, the traditional engine cam system is completely replaced with electrohydraulic or electro-mechanical actuators that directly drive individual engine valves. All current production variable valve systems are cam-based, although camless systems will offer broader controllability, such as cylinder and valve deactivation, and thus better fuel economy.

Problems with an electromechanical camless system include difficulty associated with soft-landing, high electrical power demand, inability or difficulty to control lift (or stroke), and limited ability to deal with high and/or varying cylinder air pressure. An electrohydraulic camless system can generally overcome such problems, but it does have its own problems such as performance at high engine speeds and design or control complexity, resulting from the conflict between the response time and flow capability. To operate at up to 6,000 to 7,000 rpm, an actuator has to first accelerate and then decelerate an engine valve over a range of 8 mm within a period of 2.5 to 3 milliseconds. The engine valve has to travel at a peak speed of about 5 m/s. These requirements have stretched the limit of conventional electrohydraulic technologies.

One way to overcome this performance limit is to incorporate, in an electrohydraulic system like in an electromechanical system, a pair of opposing springs which work with the moving mass of the system to create a spring-mass resonance or pendulum system. In the quiescent state, the opposing springs center an engine valve between its end positions, i.e., the open and closed positions. To keep the engine valve at one end position, the system has to have some latch mechanism to fight the net returning force from the spring pair, which accumulates potential energy at either of the two ends. When traveling from one end position to the other, the engine valve is first driven and accelerated by the spring returning force, powered by the spring-stored potential energy, until the mid of the stroke where it reaches its maximum speed and possesses the associated kinetic energy; and it then keeps moving forward fighting against the spring returning force, powered by the kinetic energy, until the other end, where its speed drops to zero, and the associated kinetic energy is converted to the spring-stored potential energy.

With its well known working principle, this spring-mass system by itself is very efficient in energy conversion and reliable. Much of the technical development has been to design an effective and reliable latch-release mechanism which can hold the engine valve to its open or closed position, release it as desired, add additional energy to compensate for frictions and highly variable engine cylinder air pressure, and damp out extra energy before its landing on the other end. As discussed above, there have been difficulties associated with electromechanical or electromagnetic latch-release devices. There has also been effort in the development of electrohydraulic latch-release devices.

Disclosed in U.S. Pat. No. 4,930,464, assigned to DaimlerChrysler, is an electrohydraulic actuator including a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. When the engine valve is at the closed position, the bypass is not in effect, the piston divides the cylinder into a larger open-side chamber and a smaller closed-side chamber, and the engine valve can be latched when the open-side and closed-side chambers are exposed to high and low pressure sources, respectively, because of the resulting differential pressure force on the piston in opposite to the returning spring force. When the engine valve is at the open position, the piston divides the cylinder into a larger closed-side chamber and a smaller open-side chamber, and the engine valve can be latched by exposing a larger closed-side chamber and smaller open-side chamber with high and low pressure sources, respectively.

At either open or closed position, the engine valve is unlatched by briefly opening a 2-way trigger valve to release the pressure in the larger chamber and thus eliminate the differential pressure force on the piston, triggering the pendulum dynamics of the spring-mass system. The 2-way valve has to be closed very quickly again, before the stroke is over, so that the larger chamber pressure can be raised soon enough to latch the piston and thus the engine valve at its new end position. This configuration also has a 2-way boost valve to introduce extra driving force on the top end surface of the valve stem during the opening stroke.

The system just described has several potential problems. The 2-way trigger valve has to be opened and closed in a timely manner within a very short time period, no more than 3 ms. The 2-way boost valve is driven by differential pressure inside the two cylinder chambers, or stroke spaces as the inventers refer as, and there is potentially too much time delay and hydraulic transient waves between the boost valve and cylinder chambers. Near the end of each stroke, the larger cylinder chamber has to be back-filled by the fluid fed through a restrictor, which demands a fairly decent opening size on the part of the restrictor. On the other hand, at the onset of the each stroke, the 2-way trigger valve has to relieve the larger chamber which is in fluid communication with the high pressure fluid source through the same restrictor. During a closing stroke, there is no effective means to add additional hydraulic energy until near the very end of the stroke, which may be a problem if there are too much frictional losses. Also, this invention does not have means to adjust its lift.

DaimlerChrysler has also been assigned U.S. Pat. Nos. 5,595,148, 5,765,515, 5,809,950, 6,167,853, 6,491,007, and 6,601,552, which disclose improvements to the teachings of U.S. Pat. No. 4,930,464. The subject matter up to U.S. Pat. No. 6,167,853 resulted in various hydraulic spring means to add additional hydraulic energy at the beginning of the opening stroke to overcome engine cylinder air pressure force. One drawback of the hydraulic spring is its rapid pressure drop once the engine valve movement starts.

In U.S. Pat. No. 6,601,552, a pressure control means is provided to maintain a constant pressure in the hydraulic spring means over a variable portion of the valve lift, which however demands that the switch valve be turned between two positions within a very short period time, say 1 millisecond. The system again contains two compression springs: a first and second springs tend to drive the engine valve assembly to the closed and open positions, respectively. The hydraulic spring means is physically in serial with the second compression spring. During a substantial portion of an opening stroke, it is attempted to maintain the pressure in the hydraulic spring despite of the valve movement and thus provide additional driving force to overcome the engine cylinder air pressure and other friction, resulting in a net fluid volume increase in the hydraulic spring means and an effective preload increase in the second compression spring because of a force balance between the hydraulic and compression springs. In the following valve closing stroke, the engine valve may not be pushed all the way to a full closing because of higher resistance from the second compression spring.

A concern common to this entire family of inventions is that there have to be two switchover actions of the control valve for each opening or closing stroke. Another common issue is the length of the actuator with the two compression springs separated by a hydraulic spring. When the springs are aligned on the same axis, as disclosed in U.S. Pat. No. 5,809,950, the total height may be excessive. In the remaining patents of this family, the springs are not aligned on a straight axis, but are instead bent at the hydraulic spring, and the fluid inertia, frictional losses, and transient hydraulic waves and delays may become serious problems. Another common problem is that the closing stroke is driven by the spring pendulum energy only, and an existence of substantial frictional losses may pose a serious threat to the normal operation. As to the unlatching or release mechanism, some embodiments use a 3-way trigger valve to briefly pressurize the smaller chamber of the cylinder to equalize the pressure on both surfaces of the piston and reduce the differential pressure force on the piston from a favorable latching force to zero. Still the trigger valve has to perform two actions within a very short period of time.

U.S. Pat. No. 5,248,123 discloses another electrohydraulic actuator including a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. Much like the referenced DaimlerChrysler patents, it has the larger chamber of the hydraulic cylinder connected to the high pressure supply all the time. Different from DaimlerChrysler, however, it uses a 5-way 2-position valve to initiate the valve switch and requires only one valve action per stroke. The valve has five external hydraulic lines: a low-pressure source line, a high-pressure source line, a constant high-pressure output line, and two other output lines that have opposite and switchable pressure values. The constant high pressure output line is connected with the larger chamber of the cylinder. The two other output lines are connected to the two ends of the cylinder and are selectively in communication with the smaller chamber of the cylinder. Much like the DaimlerChrysler disclosures, it has no effective means to add hydraulic energy at the beginning of a stroke to compensate for the engine cylinder air force and friction losses. It is not capable of adjusting valve lift either.

The actuators, and corresponding methods and systems for controlling such actuators described in my co-pending U.S. patent application Ser. No. 11/154,039, the entire content of which is incorporated herein by reference, provide independent lift and timing control with minimum energy consumption. In an exemplary embodiment, an actuation cylinder in a housing defines a longitudinal axis and having first and second ends in first and second directions. An actuation piston in the cylinder, with first and second surfaces, is moveable along the longitudinal axis. First and second actuation springs bias the actuation piston in the first and second directions, respectively. A first fluid space is defined by the first end of the actuation cylinder and the first surface of the actuation piston, and a second fluid space is defined by the second end of the actuation cylinder and the second surface of the actuation piston. A fluid bypass short-circuits the first and second fluid spaces when the actuation piston is not substantially proximate to either the first or second end of the actuation cylinder. A first flow mechanism is provided in fluid communication between the first fluid space and a first port, and a second flow mechanism is provided in fluid communication between the second fluid space and a second port. The actuator may be coupled to a stem to form a variable valve actuator in an internal combustion engine, for example.

SUMMARY OF THE INVENTION

The present invention provides significant advantages over other actuators and valve control systems, and methods for controlling actuators and/or engine valves. In addition to the inherent capability of timing control, the ability of various embodiments to provide continuous valve lift or stroke control enhances engine fuel economy, emission and overall functionality.

By virtue of the invention, the power-off state of the actuator is at the minimum stroke, from which an easy start-up can be directly executed. The minimum stroke is also very beneficial to achieve efficient low load operation. Even with continuous lift variation, the present invention is able to keep the spring force neutral or zero point in the center of a stroke, thus maintaining an efficient scheme of energy conversion and recovery through the pendulum action.

By adding a substantial hydraulic force to coincide with the spring returning force at the beginning of each stroke, the system can help overcome the engine cylinder air pressure and compensate for frictional losses. The present invention is able to incorporate lash adjustment into all alternative preferred embodiments. It is also possible to trigger and complete one engine valve stroke by just one, instead of two, switch actions of the actuation switch valve.

One preferred embodiment of an electrohydraulic actuator according to the invention comprises a housing having first and second fluid ports, a stroke controller slideably disposed in the housing, first and second partial cylinders in the housing and the stroke controller, respectively, defining a longitudinal axis and having cylinder first and second ends in first and second directions, respectively, an actuation piston between the first and second partial cylinders with first and second surfaces moveable along the longitudinal axis, first and second actuation springs biasing the actuation piston in the first and second directions, respectively.

The actuator further includes a first fluid space defined by the cylinder first end and the piston first surface, a second fluid space defined by the cylinder second end and the piston second surface, a fluid bypass that short-circuits the first and second fluid spaces when the actuation piston does not overlap either of the first and second partial cylinders. Attached to the piston first surface are a first neck and a first piston rod, and attached to the piston second surface are a second neck and a second piston rod. The housing contains a first bore distal, in the first direction, to and in fluid communication with the first fluid space, whereas the stroke controller contains a second bore distal, in the second direction, to and in fluid communication with the second fluid space. A first chamber inside the housing is in fluid communication with the first port and the first bore, and a second chamber inside the stroke controller is in fluid communication with the second bore. A first groove is one or more undercuts situated between and in fluid communication with the second chamber and the second port and, independent of the longitudinal location of the stroke controller.

Traversing the first and second piston rods, respectively, are first and second rod passages which are in fluid communication with the fluid bypass via one or more center passages longitudinally inside the first and second piston rods, the first and second necks and the actuation piston and one or more piston passages traversing the actuation piston. A second-supplemental chamber is one or more undercuts around the first bore further distal, in the first direction, to the first chamber and in fluid communication with the second port, and a first supplemental chamber is one or more undercuts around the second bore, further distal, in the second direction, to the second chamber. A second groove is one or more undercuts situated between and in fluid communication with the first-supplemental chamber and the first port, independent of the longitudinal location of the stroke controller.

A first flow mechanism includes the first neck, the first piston rod, the first bore, and the first chamber, whereby controlling fluid communication between the first fluid space and the first port. A second flow mechanism includes the second neck, the second piston rod, the second bore, and the second chamber, whereby controlling fluid communication between the second fluid space and the second port. A first-supplemental flow mechanism includes the second groove, the first-supplemental chamber, the second rod passage, the center passage, the piston passage and the fluid bypass, whereby controlling fluid communication between the first fluid space and the first port. A second-supplemental flow mechanism includes the second-supplemental chamber, the first rod passage, the center passage, the piston passage and the fluid bypass, whereby controlling fluid communication between the second fluid space and the second port.

The actuator further comprises one or more snubbers, whereby the speed of the actuation piston is substantially damped when the piston travels approaching either of the cylinder first and second ends. An engine valve is operably connected to the second piston rod.

The inside dimension of the first bore is slightly larger than the outside dimension of the first piston rod and substantially larger than the outside dimension of the first neck, and the first piston rod blocks fluid communication between the first bore and the first chamber and thus closes the first flow mechanism when the actuation piston does not overlaps the first partial cylinder. The inside dimension of the second control bore is slightly larger than the outside dimension of the second rod and substantially larger than the outside dimension of the second neck, and the second piston rod blocks fluid communication between the second bore and the second chamber and thus closes the second flow mechanism, when the actuation piston does not overlaps the second partial cylinder.

The first-supplemental flow mechanism is opened when the second rod passage at least partially overlaps the first-supplemental chamber, which happens when the actuation piston overlaps the second partial cylinder; and the second-supplemental flow mechanism is opened when the first rod passage at least partially overlaps the second-supplemental chamber, which happens when the actuation piston overlaps the first partial cylinder.

The actuation piston can be latched to the cylinder first end, such that with the engine valve in a closed position, when the second and first fluid spaces are exposed to high- and low- pressure fluid, respectively, and not short-circuited by the fluid bypass because the resulting differential pressure force on the piston is in opposite to and greater than a returning force from the first and second actuation spring. Likewise, the actuation piston can be latched to the cylinder second end, such that with the engine valve in an open position, when the first and second fluid spaces are exposed to high- and low-pressure fluid, respectively, and not short-circuited by the bypass means.

At either open or closed position, the engine valve is unlatched or released by toggling an actuation switch valve so that the pressure levels in the first and second fluid spaces are reversed, instead of being equalized as in the prior art, and thus the differential pressure force on the piston is also reversed, instead of just being reduced to almost zero like in prior art. Before the switch, the differential pressure force on the actuation piston is in opposite to and greater than the spring returning force to latch the engine valve. After the switch, the differential pressure force keeps substantially the same magnitude and reverses its direction to help the spring returning force drive the engine valve to the other position, feeding additional hydraulic energy into the system.

By virtue of the invention, the position of the stroke controller and thus the stroke are controlled by a stroke spring and the pressure force in a stroke control chamber, in addition to the forces from the actuation springs and fluid pressure in the fluid bypass and the second fluid space. In alternative embodiments, they are directly controlled by mechanical means such as a set of rack and pinion or a set of mechanically driven pins.

In the embodiment described above, the first-supplemental and second-supplemental flow mechanisms comprise the passages along the axis of the first and second piston rods and through the actuation piston. In alternative embodiments, they only include passages through the stroke controller and the housing.

First and second shoulders situated between the necks and the piston end surfaces may be used to penetrate the first and second bores to restrict fluid communication and thus to create snubbing effect. Alternatively, a fluid trapping design at the first directional end of a capped first bore is used to offer substantial hydraulic force on the first directional end of the first piston rod before the engine valve lands on the valve seat. In another preferred embodiment, it is possible to selectively supply a high pressure to a fourth port connected to the piston first rod first end to provide additional driving force in the first direction.

The present invention, together with further objects and advantages, will be best understood by reference to the following detailed description taken in conjunction with the accompanying drawings.

BRIEF DESCRIPTION OF THE DRAWINGS

FIG. 5 is a table used to explain the operation of one preferred embodiment of the hydraulic actuator;

FIG. 13*a* is a drawing of different alternative embodiment of the invention. including an end switch valve; and FIG. 13*b* is a drawing of yet a further alternative embodiment of the invention, including a differently configured end switch valve.

DETAILED DESCRIPTION OF THE INVENTION

Figure 1:
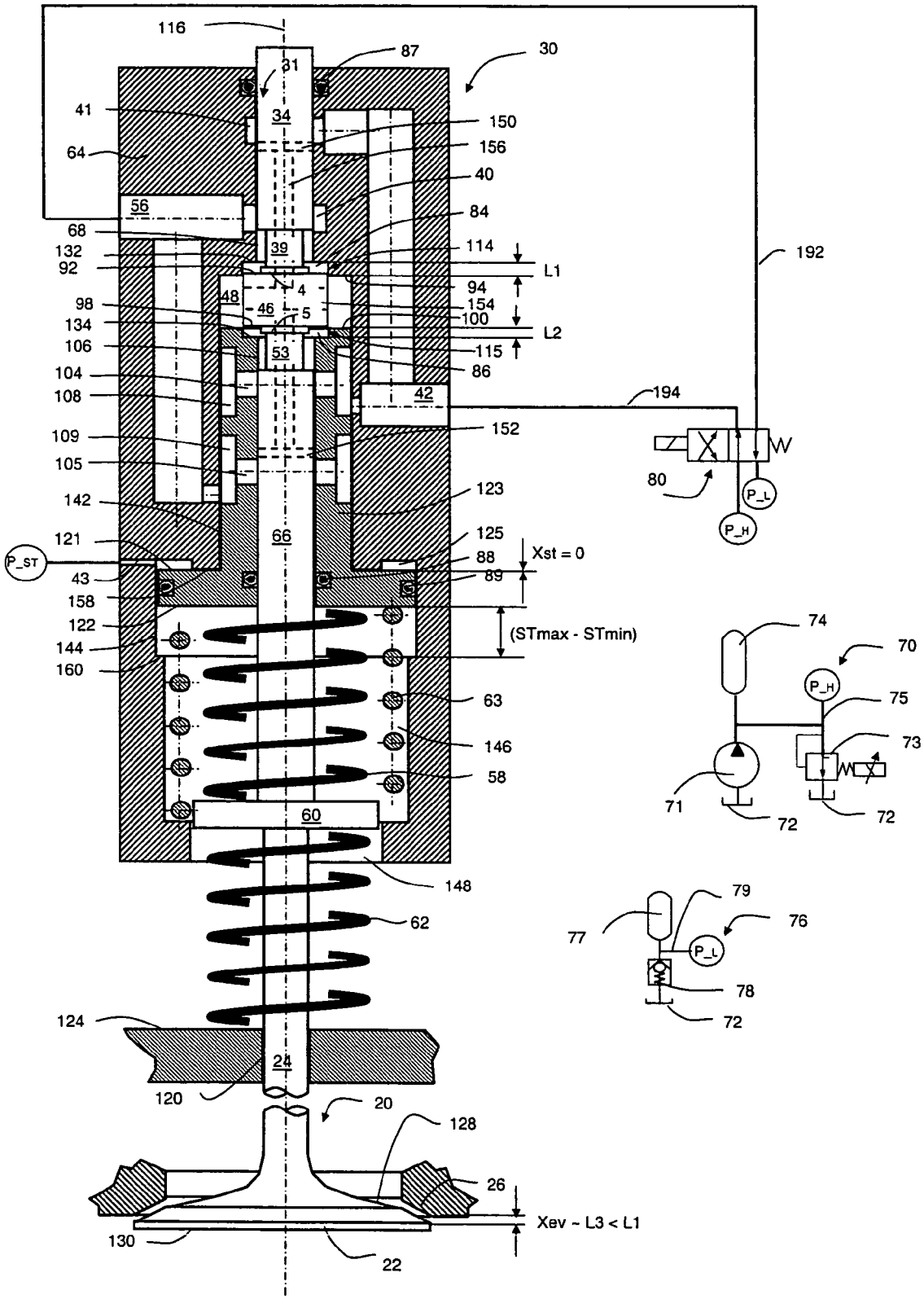
FIG. 1 is a schematic illustration of one preferred embodiment of one hydraulic actuator and hydraulic supply system according to the invention.

Referring now to FIG. 1, a preferred embodiment of the invention provides an engine valve control system using a piston, a bypass passage, and a pair of actuation spring means. The system comprises an engine valve 20, a hydraulic actuator 30, a high-pressure hydraulic source 70, a low-pressure hydraulic assembly 76, and an actuation switch valve 80.

The high-pressure hydraulic source 70 includes a hydraulic pump 71, a high-pressure regulating valve 73, a high-pressure accumulator or reservoir 74, a high-pressure supply line 75, and a hydraulic tank 72. The high-pressure hydraulic source 70 provides necessary hydraulic flow at a high-pressure P_H. The hydraulic pump 71 circulates hydraulic fluid from the hydraulic tank 72 to the rest of the system through the high-pressure supply line 75. The high-pressure P_H is regulated through the high-pressure regulating valve 73. The high-pressure accumulator 74 helps smooth out pressure and flow fluctuation and is optional depending on the total system capacity or elasticity, flow balance, and/or functional needs. The hydraulic pump 71 can be either of a variable- or fixed-displacement type, with the former being more energy efficient. The high-pressure regulating valve 73 may be able to vary the high-pressure value for functional needs and/or energy efficiency.

The low-pressure hydraulic assembly 76 includes a low-pressure accumulator or reservoir 77, the hydraulic tank 72, a low-pressure regulating valve 78, and a low-pressure line 79. The low-pressure hydraulic assembly 76 accommodates exhaust flows at a back-up or low-pressure P_L. The low-pressure line 79 takes all exhaust flows back to the hydraulic tank 72 through the low-pressure regulating valve 78. The low-pressure regulating valve 78 is to maintain a design or minimum value of the low-pressure P_L. The low-pressure P_L is elevated above the atmosphere pressure to facilitate back-filling without cavitation and/or over-retardation. The low-pressure regulating valve 78 can be simply a spring-loaded check valve as shown in FIG. 1 or an electrohydraulic valve if more control is desired. The low-pressure accumulator 77 helps smooth out pressure and flow fluctuation and is optional depending on the total system capacity or elasticity, flow balance, and/or functional needs.

The actuation switch valve 80 is a 2-position 4-way valve that supplies the hydraulic actuator 30 through a first port fluid line 192 and a second port fluid line 194. It is 4-way because it has four external hydraulic lines: a low-pressure P_L line, a high-pressure P_H line, a first port fluid line 192 and a second port fluid line 194. It is 2-position because it has two stable control positions symbolized by left and right blocks or positions in FIG. 1. Its default position is the right position secured by a return spring, and its other position is the left position forced by a solenoid. At its default or right position, the valve 80 connects the second port fluid line 194 and the first port fluid line 192 with the high pressure P_H and low pressure P_L lines, respectively. The connection order is switched when the valve 80 is at its left position.

The engine valve 20 includes an engine valve head 22 and an engine valve stem 24. The engine valve 20 is mechanically connected with and driven by the hydraulic actuator 30 along a longitudinal axis 116 through the engine valve stem 24, which is slideably disposed in the engine valve guide 120. When the engine valve 20 is fully closed, the engine valve head 22 is in contact with an engine valve seat 26, sealing off the air flow in/out of the associated engine cylinder.

The hydraulic actuator 30 comprises an actuator housing 64, within which, along the longitudinal axis 116 and from a first to a second direction (from the top to the bottom in the drawing), there are a first bore 68, which is interrupted by a second-supplemental chamber 41 and a first chamber 40, a first partial cylinder 114, a first cavity 142, a second cavity 144, a third cavity 146 and a fourth cavity 148. A stroke controller 123 resides slideably inside the first and second cavities 142 and 144. Inside the stroke controller 123 from the first to second direction, there are a second partial cylinder 115 and a second bore 106, which is interrupted by a second chamber 104 and a first-supplemental chamber 105.

Slideably within these hollow elements of the housing 64 and the stroke controller 123 lies a shaft assembly 31 comprising, from the first to the second direction, a first piston rod 34, a first neck 39, a first shoulder 44, an actuation piston 46, a second shoulder 50, a second neck 53, a second piston rod 66, and a spring seat 60. The shaft assembly 31 further comprises a first rod passage 150 inside and across the first piston rod 34, a second rod passage 152 inside and across the second piston rod 66, one or more piston passages 154 inside and across the actuation piston 46, and one or more center passages 156 inside and along the shaft assembly, interconnecting the first and second rod passages 150 and 152 and the center passage 156.

There are a first fluid space 84 defined by a cylinder first end 132 and an actuation piston first surface 92 and a second fluid space 86 defined by a cylinder second end 134 and the actuation piston second surface 98.

The actuation switch valve 80 communicates with the first chamber 40 through a first port 56 and the first fluid line 192 and with the second chamber 104 through a first groove that is one or more undercuts, a second port 42, and the second port fluid line 194. For the purpose of easy illustration, the first and second ports 56 and 42 and their associated flow channels are in the same plane and 180-degree apart, which is not necessarily so in its physical rendition. For example, it may be physically more attractive to place them substantially on the same side of the housing 64 for easy connection with the actuation switch valve 80. First and second grooves 108 and 109 are intended to keep, regardless the longitudinal position of the stroke controller relative to the actuator housing 64, uninterrupted fluid communication between the second chamber 102 and the second port 42 and between the first-supplemental chamber 105 and the first port 56, respectively. The grooves 108 and 109 also help keep hydrostatic force balance on the stroke controller 123.

The first cavity 142 has a substantially larger cross-section than the actuation piston 46 does, resulting in a bypass passage 48, which provides a hydraulic short circuit between the first and second fluid spaces 84 and 86 when the actuation piston 46 does not longitudinally overlaps either of the two partial cylinders 114 and 115. With the hydraulic short circuit, fluid may flow with substantially low resistance between the first and second fluid spaces 84 and 86, which are thus at substantially equal pressure. The radial clearance between the first piston rod 34 and the first bore 68 and that between the second piston rod 66 and the second bore 106 are substantially small and restrictive to fluid flow.

Most of the design details are intended to control fluid communication between the first fluid space 84 and the first port 56 and that between the second fluid space 86 and the second port 42 through four flow mechanisms FM1, FM1S, FM2 and FM2S described in details in FIG. 2, which, like several other figures later, does not include all parts of the actuator 30 for ease of illustration and visualization. The first flow mechanism FM1 and the first-supplemental flow mechanism FM1S control fluid communication between the first fluid space 84 and the first port 56 through. The first flow mechanism FM1 runs through the first chamber 40 and the annular space between the first bore 68 and the first neck 39, whereas the first-supplemental flow mechanism FM1S runs through the second groove 109, the first-supplemental chamber 105, the second rod passage 152, the center passage 156, the piston passage 154, and the bypass passage 48. The first flow mechanism FM1 is open only when the actuation piston 46 longitudinally overlaps or penetrates into the first partial cylinder 114 because by design, the first piston rod 34 at least partially underlaps the first chamber 40, thus allowing for the flow. The first-supplemental flow mechanism FM1S is open only when the actuation piston 46 longitudinally overlaps or penetrates into the second partial cylinder 115 because by design, the first-supplemental chamber 105 and the second rod passage 152 overlap each other, and the actuation piston 46 does not block the first partial cylinder 114.

The second flow mechanism FM2 and second-supplemental flow mechanism FM2S control fluid communication between the second fluid space 86 and the second port 42. The second flow mechanism FM2 runs through the first groove 108, the second chamber 104 and the annular space between the second bore 102 and the second neck 53, whereas the second-supplemental flow mechanism FM2S runs through the second-supplemental chamber 41, the first rod passage 150, the center passage 156, the piston passage 154, and the bypass passage 48. The second flow mechanism FM2 is open only when the actuation piston 46 longitudinally overlaps or penetrates into the second partial cylinder 115 because by design, the second piston rod 66 at least partially underlaps the second chamber 104, thus allowing for the flow. The second-supplemental flow mechanism FM2S is open only when the actuation piston 46 longitudinally overlaps or penetrates into the first partial cylinder 114 because by design, the second-supplemental chamber 41 and the first rod passage 150 overlap each other, and the actuation piston 46 does not block the second partial cylinder 115.

With the four flow mechanisms FM1, FM1S, FM2 and FM2S, the first and second fluid spaces 84 and 86 are guaranteed fluid communication with the first and second ports 56 and 42, respectively, when there is no short circuit through the bypass passage 48. When the bypass is effective, each of the four flow mechanisms is blocked or closed, and thus each of the two fluid spaces is closed off from its respective port, preventing an open flow between two ports 42 and 56 and energy losses. These controls are valid throughout the designed stroke range of the actuator 30, i.e. independent of the position of the stroke controller.

The stroke controller 123 further comprise a flange in the second direction and associated stroke controller first and second surfaces 121 and 122. Inside the second cavity 144 and in the first direction away from the stroke controller first surface 121 is a stroke control chamber 125. The fluid exchange in and out of the stroke control chamber 125 is primarily controlled by a stroke control pressure P_ST through a third port 43. There also may be some internal fluid leakage or exchange between the stroke control chamber 125 and the second groove 109. The stroke control chamber 125 is intended to help control the position of the stroke controller 123 and thus the engine valve stroke.

The longitudinal position of the stroke controller 123 relative the housing 64 results from the balance of the following major forces: the contact force from the actuation piston 46 to the cylinder second end 134 when they are in contact, the hydraulic static force on the cylinder second end 134 from the pressure inside the second fluid space 86, the hydraulic static force on a bypass second edge 100, the hydraulic static force on the stroke controller first surface 121 from the pressure inside the stroke control chamber 125, and forces from a stroke spring 63 and a second actuation spring 58 on the stroke controller second surface 122. The inclusion of the stroke spring 63 is optional, depending on the balance of the rest of the forces and the stroke control requirements, and it may be eliminated if the preload of the actuation spring 58 is sufficient.

Many of the above mentioned forces are dynamic in nature. The contact force from the actuation piston 46 to the cylinder second end 134 exists only when they are in contact. The hydraulic static force on the cylinder second end 134 changes with the pressure inside the second fluid space 86, which alternates primarily between the system high pressures P_H and low pressure P_L and is also influenced by transient snubbing pressure. The hydraulic static force on the bypass second edge 100 varies with the pressure inside the bypass passage, which stays primarily at the system high pressure P_H and experiences transient low pressure pulse during engine valve switches between the open and closed positions. The spring force from the second actuation spring 58 on the stroke controller second surface 122 varies with the extent of the compression of the second actuation spring 58, which in turn depends on relative positions of the stroke controller 123 and the engine valve 20. The hydraulic static force from the pressure inside the stroke control chamber 125 and the spring force from the stroke spring 63 on the stroke controller second surface 122 are independent of the engine valve movement and thus provide the stability to the position of the stroke controller 123. The spring force from the second actuation spring 58 also has a stable component, i.e., its pre-load. The stability is further achieved by making the third port 43 fairly restrictive to fluid flow, thus damping out the high frequency oscillation caused by the engine valve switching. The third port 43 has yet to be fairly open enough to accommodate the minimum time response requirement for the stroke control. The restrictiveness of the port 43 can be replaced by another restrictive means, not shown here, between the port 43 and its fluid supply source while keeping the port 43 itself fairly open.

Figure 3:
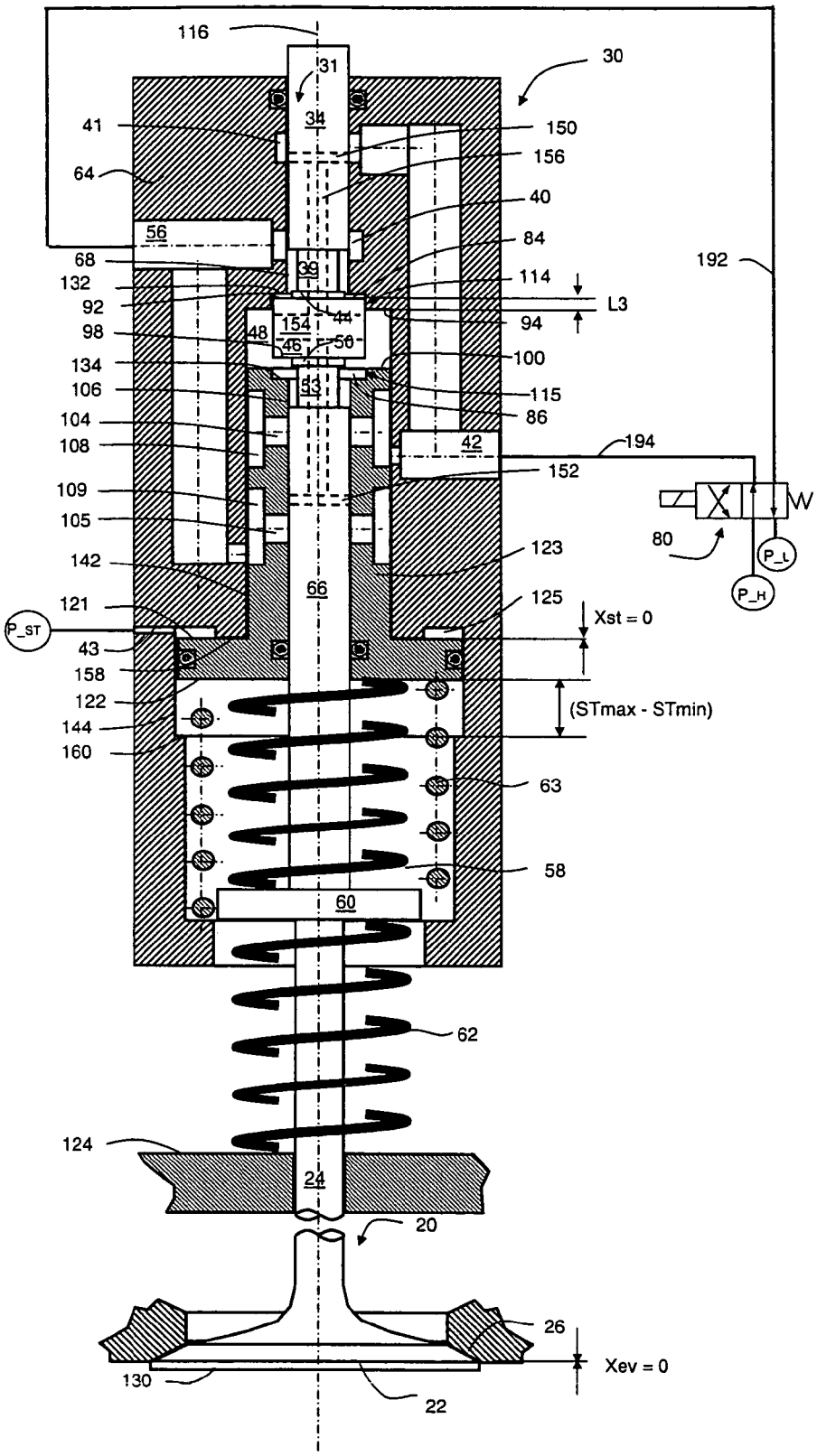
FIG. 3 is a schematic illustration of one preferred embodiment of the hydraulic actuator, which is complete with initialization. The engine valve is in closed position.
Figure 4:
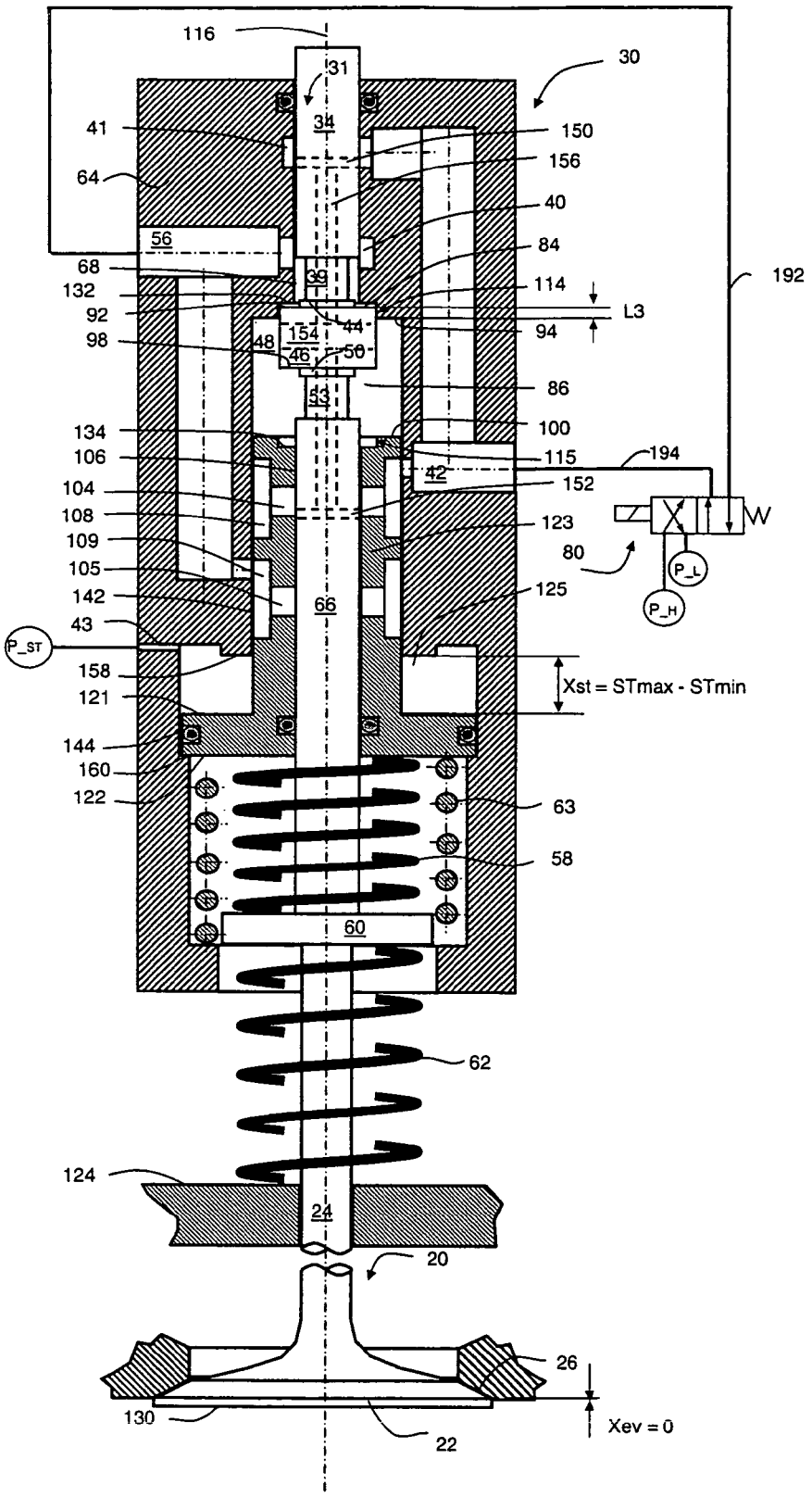
FIG. 4 is a schematic illustration of one preferred embodiment of the hydraulic actuator, with the maximum stroke and at the beginning of an opening stroke or travel in the second direction.

When the system power is off as shown in FIG. 1, the hydraulic static forces are all zero, and thus the stroke controller 123 is pushed by the springs 63 and 58 all the way against the second cavity first end 158, when the stroke controller displacement Xst=0, and the engine valve stroke ST=STmin+Xst=STmin, with STmin being the minimum stroke and approximately equal to L2+L3, where L2 is the depth or length of the second partial cylinder 115 as shown in FIG. 1, and L3 is the overlap between the actuation piston 46 and the first partial cylinder 114 when the engine valve is fully closed as shown in FIG. 3. The L3 value varies with the state of the engine valve lash, which is accommodated by having L1>L3 during the entire useful life of an engine. If the stroke controller 123 is pushed back all the way against the second cavity second end 160 with the stroke controller displacement Xst=STmax−STmin as shown in FIG. 4, not in FIG. 1, the engine valve has the maximum stroke ST_max i.e. the engine valve stroke ST=STmin+Xst=STmin+(STmax−Stmin)=STmax. When the power is off as in FIG. 1, the longitudinal distance between the stroke controller second surface 122 and the second cavity second end 160 is equal to the difference between the maximum and minimum strokes, i.e., ST_max−ST_min.

The continuous control of the stroke for the preferred embodiment shown in FIG. 1 can be realized through varying the stroke control pressure P_ST by a proportional pressure control subsystem or valve (not shown here). One proportional pressure control valve can control several hydraulic actuators, for example, all intake actuators of an engine. The stroke can also be varied by actively varying the high pressure P_H while the stroke control pressure P_ST is relatively fixed, which is feasible because the required latching pressure happens decreases with the stroke and thus the preload of the springs. If necessary, one can regulate both P_ST and P_H, especially if P_H has to be varied for other reasons, such as energy reduction at lower strokes.

If the function of the continuous or proportional control of the stroke is not needed, the embodiment in FIG. 1 can still be effectively utilized by setting P_ST at two values: a low value to have the minimum stroke and a high value for the maximum stroke or the normal full open stroke. As explained later, the minimum stroke position is necessary for the start-up of the actuator 30. For simplicity, these two values can be simply P_H and P_L, which can be selected using a three-way valve, not shown here.

The first and second partial cylinders 114 and 115 have a length of L_1 and L_2, respectively. It is intended that the actuation piston 46 will never hits the cylinder first end 132, and its travel in the first or engine-valve-closing direction will always be stopped by the contact of the engine valve head with the engine valve seat when there is still a distance between the actuation piston first surface 92 and the cylinder first end 132 to accommodate the engine valve lash adjustment due to mechanical inaccuracy, wear and thermal expansion. When moving in the second direction and opening the engine valve, the actuation piston 46 stops when its second surface 98 hits the cylinder second end 134 which may not be a metal to metal contact if a proper snubbing mechanism or a squeeze film mechanism is designed. Preferably, the sum of the lengths L_1 and L_2 is substantially less than the valve stroke ST or the maximum valve stroke ST_max to minimize the loss of hydraulic energy.

The first and second shoulders 44 and 50 are intended to work together with the first and second bores 68 and 106 as snubbers to provide damping to the shaft assembly 31 near the end of its travel in the first and second directions, respectively. When traveling in the first direction, the actuation piston 46 pushes hydraulic fluid from the first fluid space 84 to the first chamber 40 once the actuation piston first surface 92 is distal to the bypass first edge 94. Before the end of a stroke, the first shoulder 44 is pushed into the first bore 68, resulting in a flow restriction because of a narrower radial clearance between the first shoulder 44 and the first bore 68 and thus a rising pressure inside the first fluid space 84 and on the actuation piston first surface 92, which slows down the shaft assembly 31. A similar flow restriction through the radial clearance between the second shoulder 50 and the second bore 106 helps damp the motion of the shaft assembly 31 and the engine valve 20 in the second direction.

Concentrically wrapped around the engine valve stem 24 and the second piston rod 66, respectively, are a first actuation spring 62 and the second actuation spring 58. The second actuation spring 58 is supported by the stroke controller second surface 122 and the spring seat 60, whereas the first actuation spring 62 is supported by a cylinder head surface 124 and the spring seat 60. The spring seat 60 can also be made to function as a mechanical connection between the shaft assembly 31 and the engine valve 20 or, more specifically or locally, between the second piston rod 66 and the engine valve stem 24. The actuation springs 62 and 58 are always under compression. They are preferably identical in major geometrical, physical and material parameters, such as stiffness, pitch and wire diameters, and free-length, such that their lengths are substantially equal and that the spring seat 60 is situated between the stroke controller second surface 122 and the cylinder head surface 124 when the springs 62 and 58 are at the neutral state, when the net spring force resulting from the two opposing spring forces is zero.

The shaft assembly 31 is generally under two static hydraulic forces and two spring forces. The two static hydraulic forces are the pressure forces at the actuation piston first and second surfaces 92 and 98. The two spring forces are from the two actuation springs 62 and 58 to the spring seat 60. Mathematically, the two spring forces can be combined as a net spring force.

The engine valve 20 is generally exposed to two air pressure forces on the first surface 128 and the second surface 130 of the engine valve head 22. The hydraulic actuator 30 and the engine valve 20 also experience various friction forces, steady-state flow forces, transient flow forces, and inertia forces. Steady-state flow forces are caused by the static pressure redistribution due to fluid flow or the Bernoulli effect. Transient flow forces are caused by the acceleration of the fluid mass. Inertia forces result from the acceleration of objects, excluding fluid here, with inertia, and they are very substantial in an engine valve assembly because of the large magnitude of the acceleration or the fast timing.

In FIG. 1, there are three seals 87, 88 and 89 to prevent external fluid leakages. If desired, one can also add seals to prevent internal leakages among various ports, chambers, passages, etc. If desired, one can also eliminate the seals 87, 88 and 89 to reduce associated frictional forces, use tolerance control to minimize the external leakages, and design proper channeling means to return unpreventable leakages back into the fluid tank.

Start-Up

When the power is off, the status of the system is substantially as that shown in FIG. 1. The actuation switch valve 80 is at its default or right position. The second port 42 and the first port 56 are connected to the P_H and P_L lines, respectively. The P_ST, P_H and P_L lines are all at zero gage pressure because the pump 71 is off. There is no net hydraulic force on the hydraulic actuator 30, and there is no air force on the engine valve 20 either because the engine is not running.

Ignoring the frictional and gravitational forces, the stroke controller 123 is pushed by the second actuation spring 58 and the stroke spring 63 all the way in the first direction against the second cavity first end 158. The two actuation springs 62 and 58 are compressed equally to keep force balance or to be at the neutral state. By proper longitudinally sizing or design, the actuation piston 46 and the bypass passage 48 should preferably be substantially equal in length, and the actuation piston 46 is positioned slight biased in the first direction. As a result, the actuation piston 46 slightly overlaps the first partial cylinder 114 and slightly underlaps the second partial cylinder 115, the first rod passage 150 slightly overlaps the first-supplemental chamber 41, the second rod passage 152 slightly underlaps the first-supplemental chamber 105, the first piston rod 34 slightly underlaps the first chamber 40, and the second piston rod 66 completely overlaps the second chamber 104. As a further result, the first flow mechanism FM1 and the second-supplemental flow mechanism FM2S are slightly open, while the first-supplemental flow mechanism FM1S and the second flow mechanism FM2 are more restricted. The extent of the above underlapping, overlapping, opening and restriction is enhanced with the increase in lash. The engine valve 20 has an opening less than L1.

At engine start, the hydraulic pump 71 is turned on first to pressurize the hydraulic circuit. During vehicle operation, the hydraulic pump 71 is preferably driven directly by the engine. One may have to use a supplemental electrical means (not shown here) to start the hydraulic pump 71, or to add an electrically-driven supplemental pump (also not shown).

At this point, the stroke control pressure P_ST is to be regulated at its minimum value so that the stroke controller 123 stays stationary and in contact with the second cavity first end 158. The actuation switch valve 80 is still at default or right position as shown in FIG. 1, and the first and second ports 56 and 42 are connected to the low and high system pressures P_L and P_H, respectively. The first and second fluid spaces 84 and 86 are therefore exposed to the low and high system pressures P_L and P_H through the first fluid mechanism FM1 and the second-supplemental fluid mechanism FM2S, respectively, although the extent of their openings are limited.

The pressure differential between the two fluid spaces 84 and 86 will be enough to drive the actuation piston 46 in the first direction and enhance the openings in the first fluid mechanism FM1 and the second-supplemental fluid mechanism FM2S, which induces a positive feedback between the shaft movement and the pressure differential until a completion of the start-up when the movement is stalled by the mechanical contact between the engine valve 22 and the valve seat 26 as shown in FIG. 3. The shaft assembly 31 and the engine valve 22 will stay at that position because the differential pressure force on the piston 46 is designed to over-power the net spring return force and latch them in position.

The state in FIG. 3 is the longest-lasting stable state for the engine valve 20, which for a typical engine operation stays closed roughly ¾ of the thermodynamic cycle. For the most of the rest of the cycle, the engine valve 20 travels to the other stable state (the fully open state), stays there, and returns from it.

In the above description of a start-up in the first direction, the actuation piston 46 and the bypass passage 48 are substantially equal in length, and the actuation piston 46 is longitudinally positioned with a slight bias in the first direction at the beginning. It is a better starting situation. If the actuation piston 46 is longitudinally positioned with no bias at the beginning, the initial pressure and kinetic energy build-up may not be as fast, and it will still work. If the actuation piston 46 is longitudinally positioned with a slight bias in the second direction at the beginning, there will be a switch from of the flow mechanisms, from the first-supplemental flow mechanism FM1S to the first flow mechanism FM1 for the first fluid space 84 and from the second flow mechanism FM2 to the second-supplemental flow mechanism FM2S for the second fluid space 86.

If the bypass passage 48 is materially shorter than the actuation piston 46, there will be a fluid short circuit between two ports 42 and 56 and thus significant energy loss when the actuation piston 46 overlaps simultaneously the first and second particular cylinders 114 and 115, thus the two rod passages 150 and 152 being connected to the second and first ports 42 and 56, respectively and simultaneous. The start-up process may still work, although not efficiently, as long as the resulting pressure loss is not too significant. The short circuit can happen during a short-stroke operation as well as a start-up.

If the bypass passage 48 is materially longer than the actuation piston 46, the start-up may experience problem if at the beginning or the neutral state, the actuation piston 46 does not overlaps any of the two partial cylinders 114 and 115, and the first and second fluid spaces 84 and 86 are short-circuited by the bypass passage 48 and are under substantially same pressure, resulting in no driving force for the start-up. The start-up may also experience problem if at the beginning of a start-up in the first direction, the actuation piston 46 overlaps the second partial cylinder 115, then disengages the overlap with the second partial cylinder 115 but has not possessed enough kinetic energy to jump over next short-circuiting distance. Likewise, the start-up may fail if at the beginning of a start-up in the second direction, the actuation piston 46 overlaps the first partial cylinder 114.

If desired, one can also complete the start-up in the second direction or with the engine valve 20 open in the end if the actuation switch valve 80 is tuned to the left position to connect the first and second ports 56 and 42 to the P_H and P_L lines, respectively. The rest of the start-up process generally reverses what is described above.

Valve Opening and Closing with the Maximum Stroke

FIG. 5 is a table to help explain the general operation of the hydraulic actuator 30. It can be illustrated with an example at the maximum stroke. With a maximum stroke control pressure, the stroke controller is pushed all the way in the second direction and allows for the maximum stroke as shown in FIG. 4. Starting from a fully closed position, with the engine valve opening Xev=0, one can start an opening stroke or travel in the second direction by switch the actuation switch 80 to the right position, connecting the first and second ports 56 and 42 with the high and low pressures P_H and P_L, respectively. The first and second fluid spaces 84 and 86 are connected to the first and second ports 56 and 42 through the first flow mechanism FM1 (as defined in FIG. 2) and the second-supplemental flow mechanism FM2S (as defined in FIG. 2), respectively, and their respective pressures reverse polarities to the high and low pressures P_H and P_L, resulting in a net hydraulic force in the second direction, which in agreement with the net spring force releases and accelerates the shaft assembly 31 and the engine valve 22 in the second direction, opening up the engine valve 22. The shaft assembly 31 and the engine valve 22 rapidly build up a velocity. It is a very important feature of this invention that to overcome frictional losses and engine air cylinder pressure, the net hydraulic force is in the second direction and helps the engine valve open, resulting from an additional energy contribution from the hydraulic design, which is in addition to the latch-release function. When the velocity gets to a certain level, there might be a substantial pressure drop from the P_H value in the first fluid space 84 because of snubbing by the first shoulder 44 and other restriction. The second fluid space 86 may also be at a higher pressure than P_L because of various flow restrictions.

Figure 2:
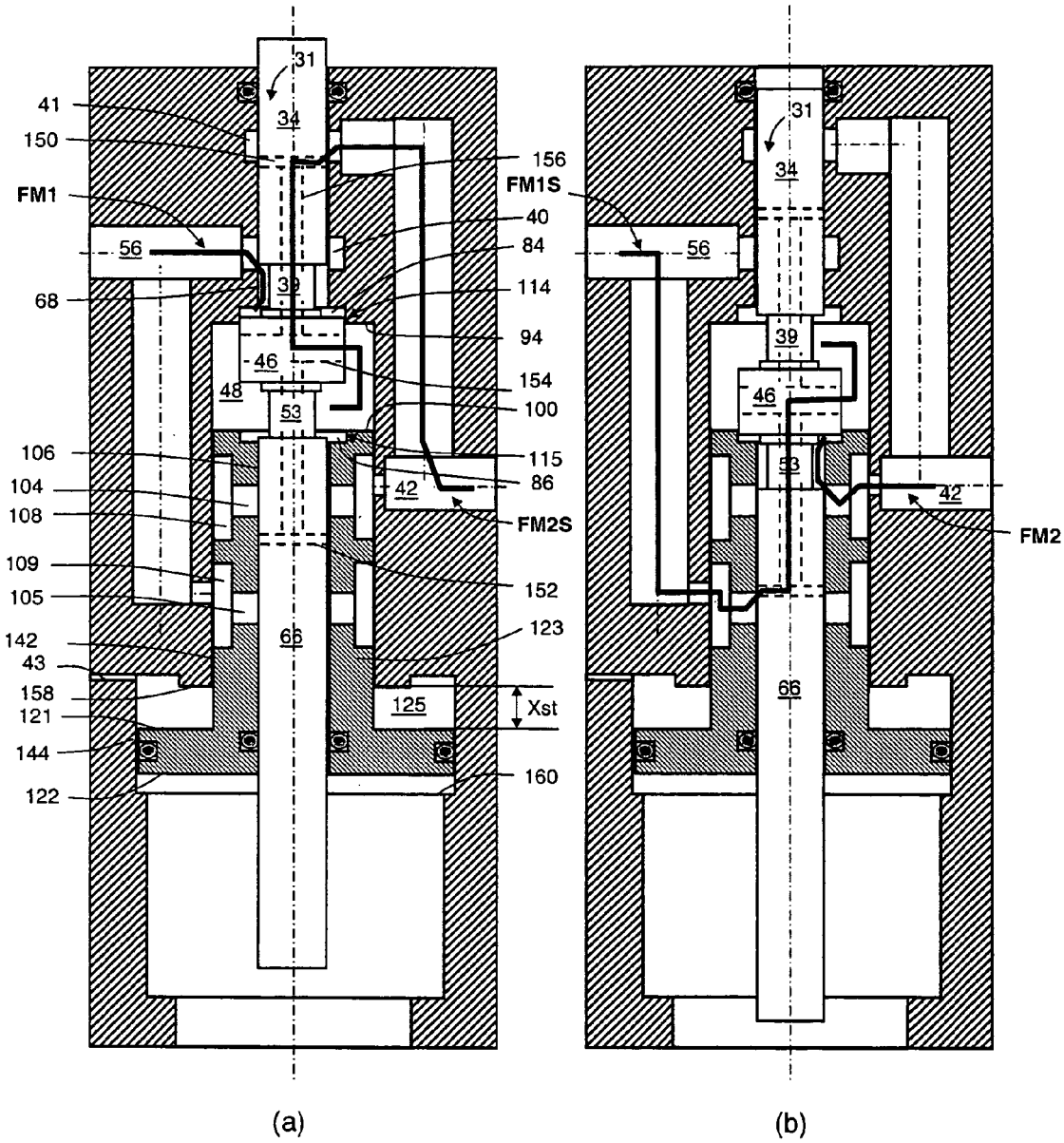
FIG. 2*a* is a schematic illustration of a hydraulic actuator with a first flow mechanism and second supplemental flow mechanism being open when an actuation piston overlaps with a first partial cylinder.
FIG. 2*b* is a schematic illustration of a hydraulic actuator with a second flow mechanism and first supplemental flow mechanism being open when an actuation piston overlaps with a second partial cylinder.

Once the actuation piston 46 disengages or underlaps the first partial cylinder 114, all four flow mechanisms FM1, FM2, FM1S and FM2S, as defined in FIG. 2, are blocked, and the fluid is displaced from the second fluid space 86 to the first fluid space 84 though the bypass passage 48 to accommodate the piston movement. Because of the low resistance, there is no substantial pressure difference between the two fluid spaces 84 and 86, whereas their absolute pressure values may fall somewhere between P_H and P_L depending on the overall leakage situation. The bypass is effective when the engine valve opening Xev is between approximately L2 and (ST−L2), during which no substantial amount of hydraulic power is consumed, and the hydraulic actuator 31 is first driven and then retarded primarily by the actuation springs 62 and 58. The potential energy stored in the springs 62 and 58 as a whole is released and continues to accelerate the hydraulic actuator 31 and the engine valve 20 until passing through the half-way point of the stroke, when the actuation springs 62 and 58 as a whole start resisting the movement in the second direction and converts the kinetic energy into the potential energy. At the half-way point of the stroke, the engine valve reaches its maximum speed.

Once the actuation piston 46 overlaps or engages the second partial cylinder 115 when the engine valve opening Xev is between ST−L2 and ST, the first and second fluid spaces 84 and 86 reestablish their fluid communication with the first and second ports 56 and 42 at their respective pressure values of P_H and P_L through the first-supplemental flow mechanism FM1S and the second flow mechanism FM2, respectively, resulting in a net static hydraulic force in the second direction. The bypass passage 48 is no longer effective. The net spring force continues to be in the first direction, increases with the travel, and slows down the shaft assembly 31 and engine valve 22.

As the second shoulder 50 penetrates deeper into the second bore 106, the resulting flow restriction generates a dynamic pressure rise in the second fluid space 86, resulting in a dynamic snubbing force in the first direction to slow down the shaft assembly 31 and the engine valve 20. The snubbing force increases with the travel and travel velocity and drops to zero when the travel stops There are therefore three primary forces: the spring force in the first direction, the static hydraulic force in the second direction, and the dynamic snubbing force in the first direction. The spring force resists and slows down the engine valve opening. The static hydraulic force assists the engine valve opening, especially if there has been excessive energy loss along the way and not enough kinetic energy in the shaft assembly 31 and the engine valve 20 for them to travel all the way to a full opening. The snubbing force tends to slow down the shaft assembly 31 and the engine valve 20 if they travel too fast before the actuation piston 46 hits the cylinder second end 134 of the second partial cylinder 115. At the full opening, i.e., the engine valve opening Xev equaling to the stroke ST, the velocity is zero, the snubbing force disappears, and the static hydraulic force is designed to be large enough to hold the engine valve 20 in place against the net spring force and other minor forces.

The surfaces of the cylinder first and second ends 132 and 134 and the actuation piston first and second surfaces 92 and 98 are not necessarily the flat surfaces as shown in FIG. 1, and they may have some taper to improve stress distribution, some shape to help squeeze-film action for impact reduction, and another shape to prevent stiction. It is also possible to design the snubber at the cylinder second end 134 in such a way that the actuation piston 46 does not hit, metal-to-metal, the cylinder second end 134 at the end of an opening stroke, at least during a dynamic operation because there is not enough to time squeeze out the trapped fluid at the location.

Closing the engine valve is effectively a reversal of the opening process described above. It is also described in the bottom half of the table in FIG. 5. It is triggered by turning the actuation switch valve 80 to its default or right position.

Valve Opening and Closing at Other Stroke Values

The opening and closing processes at other stroke values are generally the same as those at the maximum stroke. At a shorter stroke, the travel under the bypass, the spring force overall level decreases, and the peak travel speed reduces if the system pressure does not change. When the stroke is reduced to the minimum stroke STmin, the bypass phase disappears entirely.

Alternatives

Figure 6:
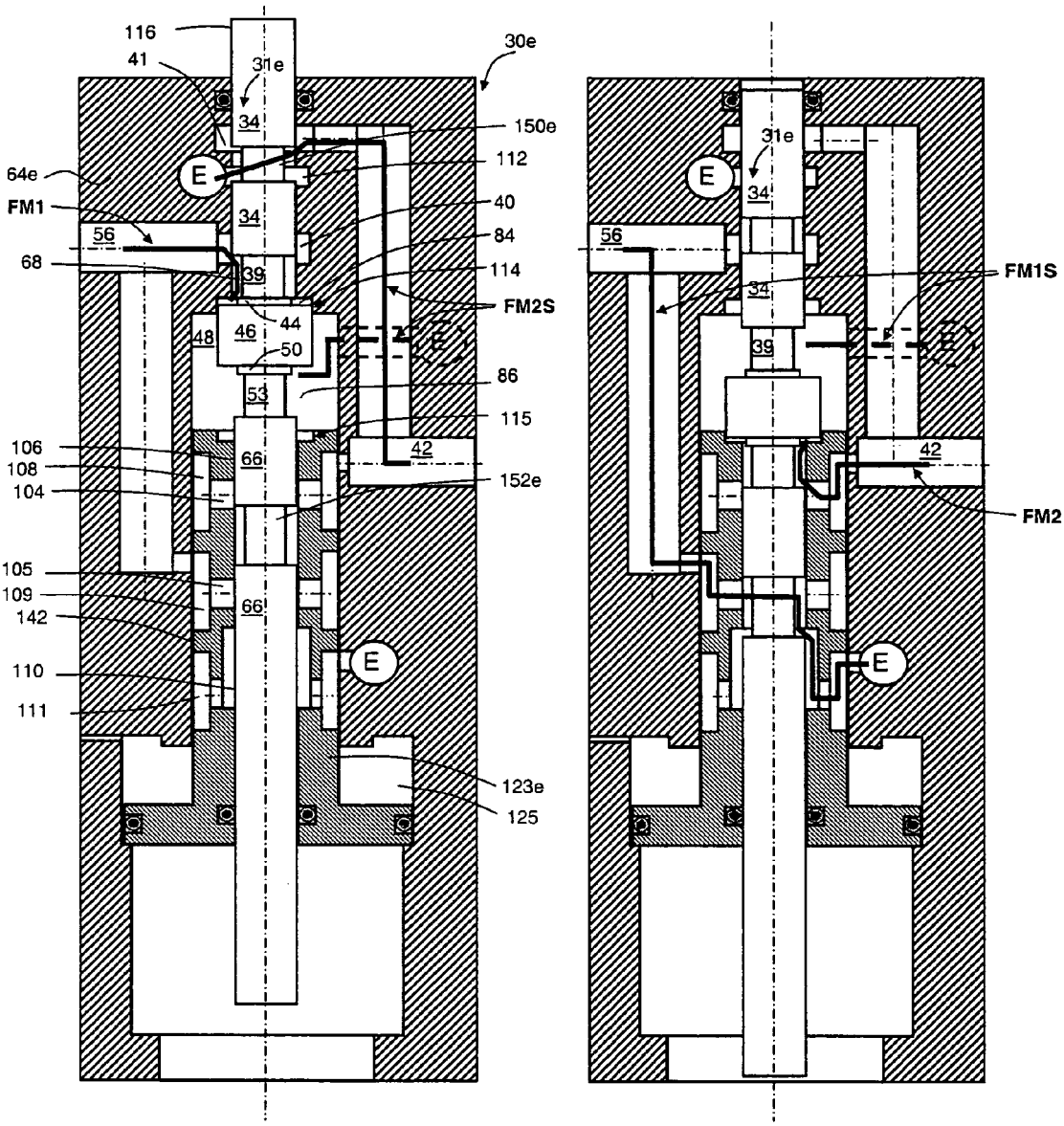
FIG. 6 is a schematic illustration of another preferred embodiment which utilizes another design of supplemental flow mechanisms.

FIG. 6 depicts an alternative embodiment of the invention. The actuator 30*e* is different from that in FIGS. 1-4 primarily in its design of supplemental flow mechanisms FM1S and FM2S, which are no longer fabricated deep inside the shaft assembly 31*e*. The first and second rod passages 150*e* and 152*e* become two circular undercuts. The stroke controller 123*e* further includes a first-supplemental chamber extension 110, which can be a circular undercut inside the second bore 106 and distal to the first-supplemental chamber 105 in the second direction, and a third groove 111, which is one or more undercuts distal to the second groove 109 in the second direction. The first-supplemental chamber extension 110 and the third groove 111 are in fluid communication through one or more holes in radial direction. The housing 64*e* further includes a second-supplemental chamber extension 112, a short distance away in the second direction from the second-supplemental chamber 41, and a fluid communication channel E-E-E, which is in fluid communication directly with the second-supplemental chamber extension 112 and the bypass passage 48 and with the first-supplemental chamber extension 110 through the third groove 111. The third groove 111 has a longitudinal expansion enough to keep non-interruptive fluid communication between the E-E-E channel and the first-supplemental chamber extension 110, independent of the axial position of the stroke controller 123*e*.

With the above changes, the first and second-supplemental flow mechanisms FM1S and FM2S in FIG. 6 are different from those in FIG. 2, whereas the first and second flow mechanisms FM1 and FM2 remain essentially the same. As shown in FIG. 6, the first-supplemental flow mechanism FM1S runs between the first port 56 and the first fluid space 84, through the second groove 109, the first-supplemental chamber 105, the second rod passage 152*e*, the first-supplemental chamber extension 110, the E-E-E passage, and the bypass passage 48. The first-supplemental flow mechanism FM1S is open only when the actuation piston 46 longitudinally overlaps or penetrates into the second partial cylinder 115.

The second-supplemental flow mechanism FM2S runs between the second port 42 and the second fluid space 86, through the second-supplemental chamber 41, the first rod passage 150*e*, the second-supplemental chamber extension 112, the E-E-E passage, and the bypass passage 48. The second-supplemental flow mechanism FM2S is open only when the actuation piston 46 longitudinally overlaps or penetrates into the first partial cylinder 114.

The addition of the first and second-supplemental chamber extension 110 and 112 and the third groove 111 is to keep balance radial-direction hydrostatic forces on the shaft assembly 31*e*, which may also necessitate lengthening the stroke controller 123*e* and the housing 64*e*.

Figure 7:
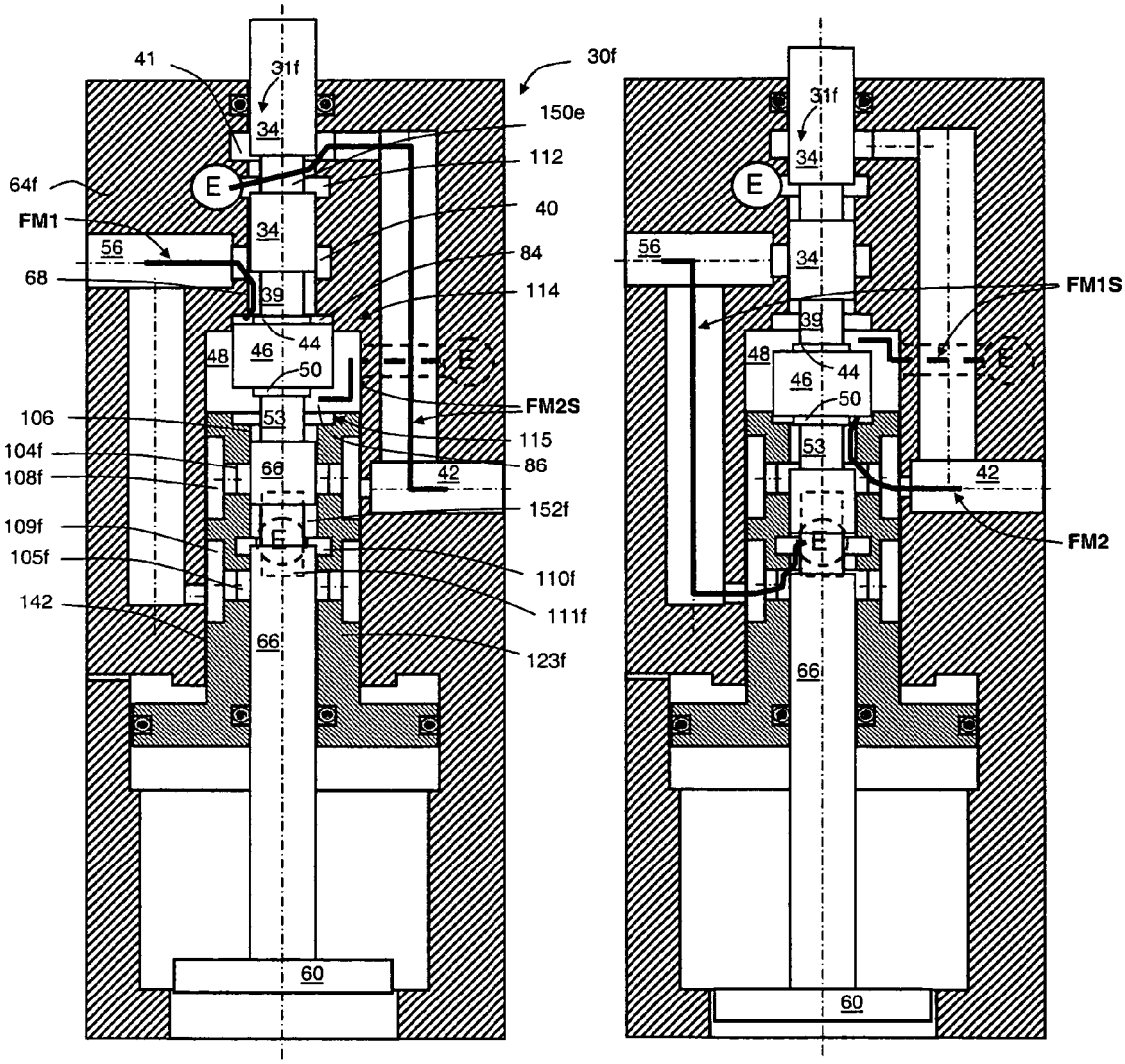
FIG. 7 is a schematic illustration of another preferred embodiment which utilizes yet another design of supplemental flow mechanisms.
Figure 8:
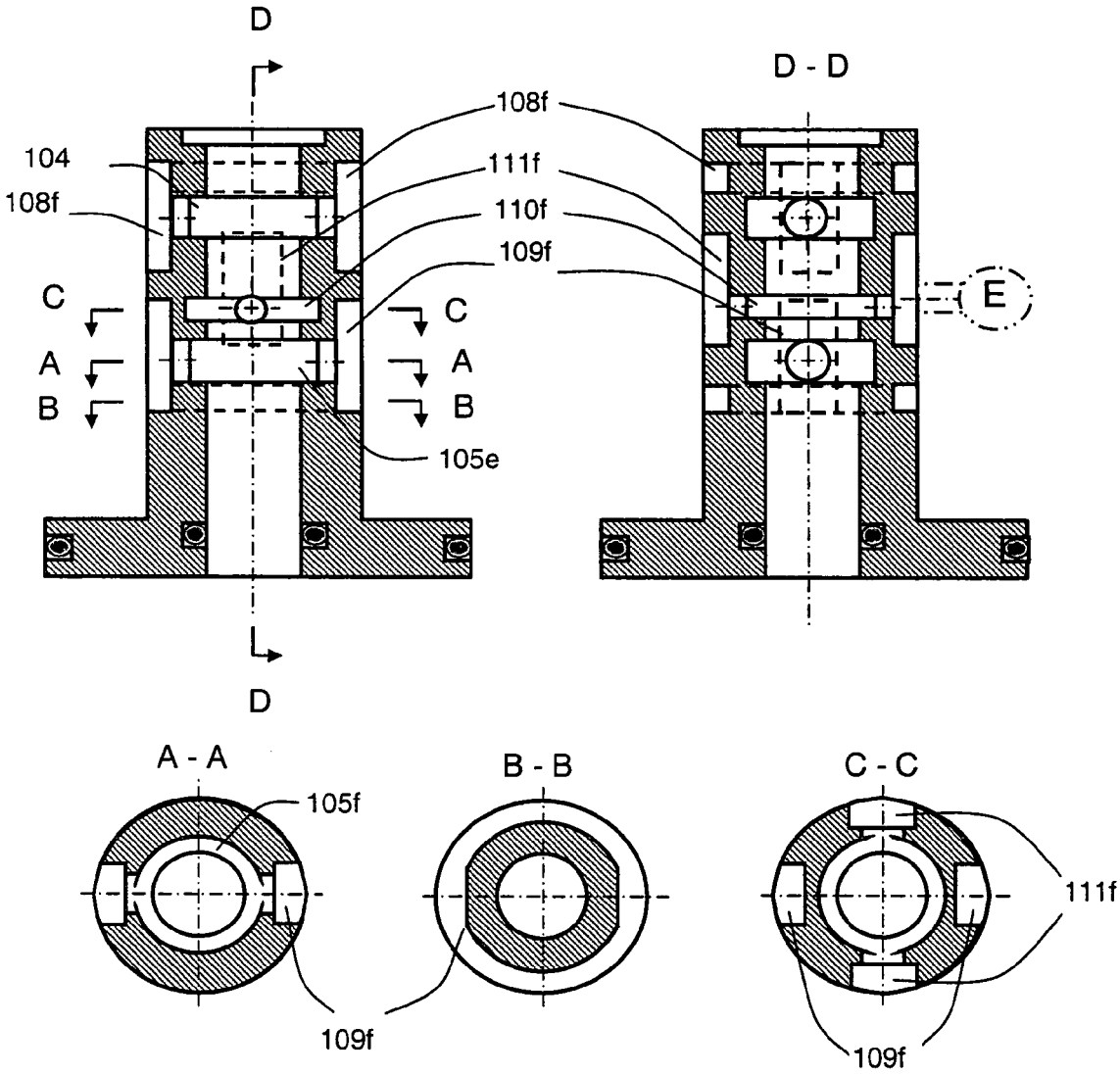
FIG. 8 depicts in more details the stroke controller of the preferred embodiment illustrated in FIG. 7.

FIG. 7 depicts an alternative embodiment of the invention, in which the third groove 111 and its associated features are placed in parallel with or in between the first and second grooves 108*f* and 109*f* to save longitudinal space. Its stroke controller 123*f* is illustrated in more details in FIG. 8. Unlike earlier versions, The first, second and third grooves 108*f*, 109*f* and 111*f* are, like the earlier versions, axisymmetric for side force balance and unlike the earlier versions, do not have enough room to have complete coverage over the entire circumference. Its flow mechanisms FM1, FM2, FM1S and FM2S are generally the same as those in the embodiment shown in FIG. 6, except for the first-supplemental flow mechanism FM1S in its spatial arrangement. The scheme used in FIGS. 7 and 8 to arrange the grooves in parallel around the circumference can also be applied to the grooves 108 and 109 in the embodiment in FIG. 1 to save the longitudinal space if necessary.

Figure 9:
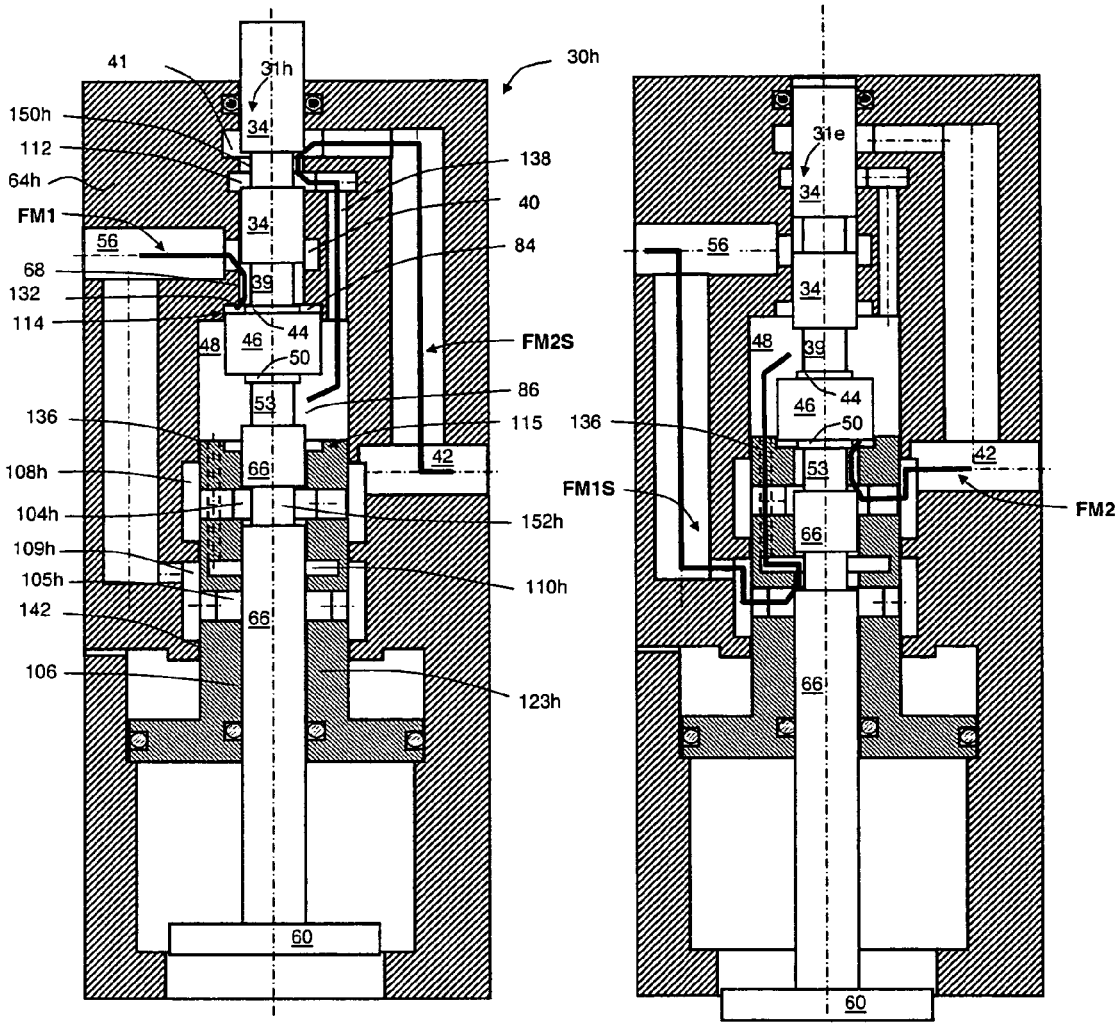
FIG. 9 is a schematic illustration of another preferred embodiment which utilizes yet another design of supplemental flow mechanisms.

Refer now to FIG. 9, there is a drawing of another alternative embodiment of the invention. This alternative embodiment utilizes another design of the first and second-supplemental flow mechanisms FM1S and FM2S, which are connected to the bypass passage 48 respectively by first-supplemental and second-supplemental channels 136 and 138. Compared with the design in FIGS. 7 and 8, it greatly simplifies the design, especially for the first-supplemental flow mechanism FM1S, and reduces internal leakage. It however requires a certain minimum amount of room in the stroke controller 123*h* and the bypass passage 48 to have an adequate cross-section size for the first-supplemental channel 136. To make room for the first-supplemental channel 136, the first and second grooves 108*h* and 109*h* are relocated from the stroke controller 123*h* to the housing 64*h*, at substantially the same longitudinal positions though, where they are still able to keep fluid communication between the second chamber 104*h* and the second port 42 and that between the first-supplemental chamber 105*h* and the first port 56, independent of the longitudinal location of the stroke controller 123*h*. This optional relocation of a groove can be extended to other embodiments and is also applicable to the third groove 111.

Figure 10:
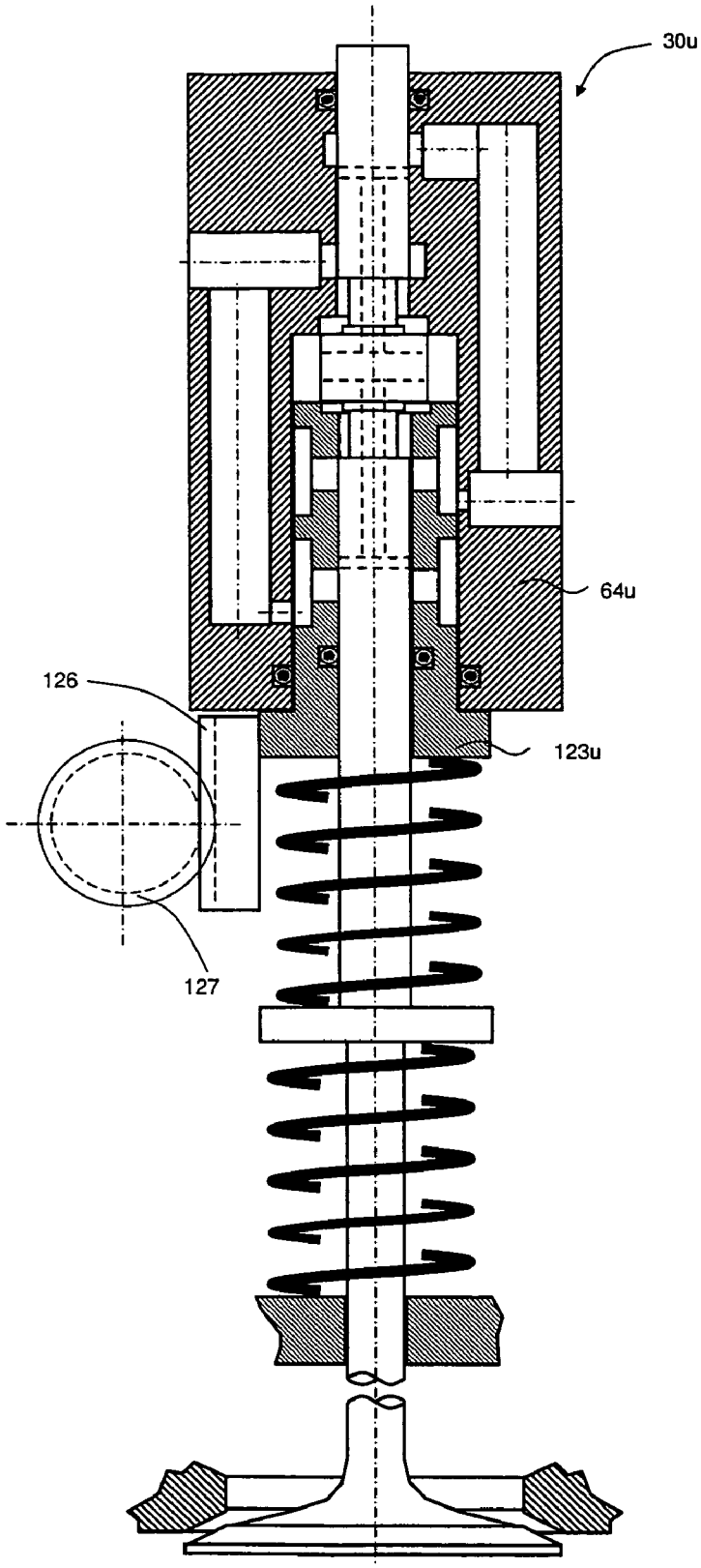
FIG. 10 is a schematic illustration of another preferred embodiment which utilizes one set of rack and pinion to drive the stroke controller.

Refer now to FIG. 10, there is a drawing of another alternative embodiment of the invention. The actuator 30*u* is different from that in FIGS. 1-4 primarily in the design of the stroke control mechanism, which is now realized by a set of rack 126 and pinion 127. The rack 126 is solidly attached the stroke controller 123*u*, which no longer has a need to form, with the housing 64*u*, a stroke control chamber. For better force balance, one may choose add another set of rack 126 and pinion 127 opposite to or 180 degrees away from the one shown in FIG. 10. The rack 126 is substantially parallel with the axis of the stroke controller 123*u* or the actuator 30*u*, and its linear displacement becomes that of the stroke controller 123*u* in either of the first and second directions. On an engine, one pinion 127 or one shaft fitted with multiple pinions, not shown here, may be designed to control a multitude of the actuator racks 126, for example, either all intake or exhaust valve actuators on a cylinder bank. It is also possible to control the position of the stroke controller 123*u* using other mechanical means, e.g. a sliding wedge or a cam, from either the first or second direction end of the actuator 30*u*.

Figure 11:
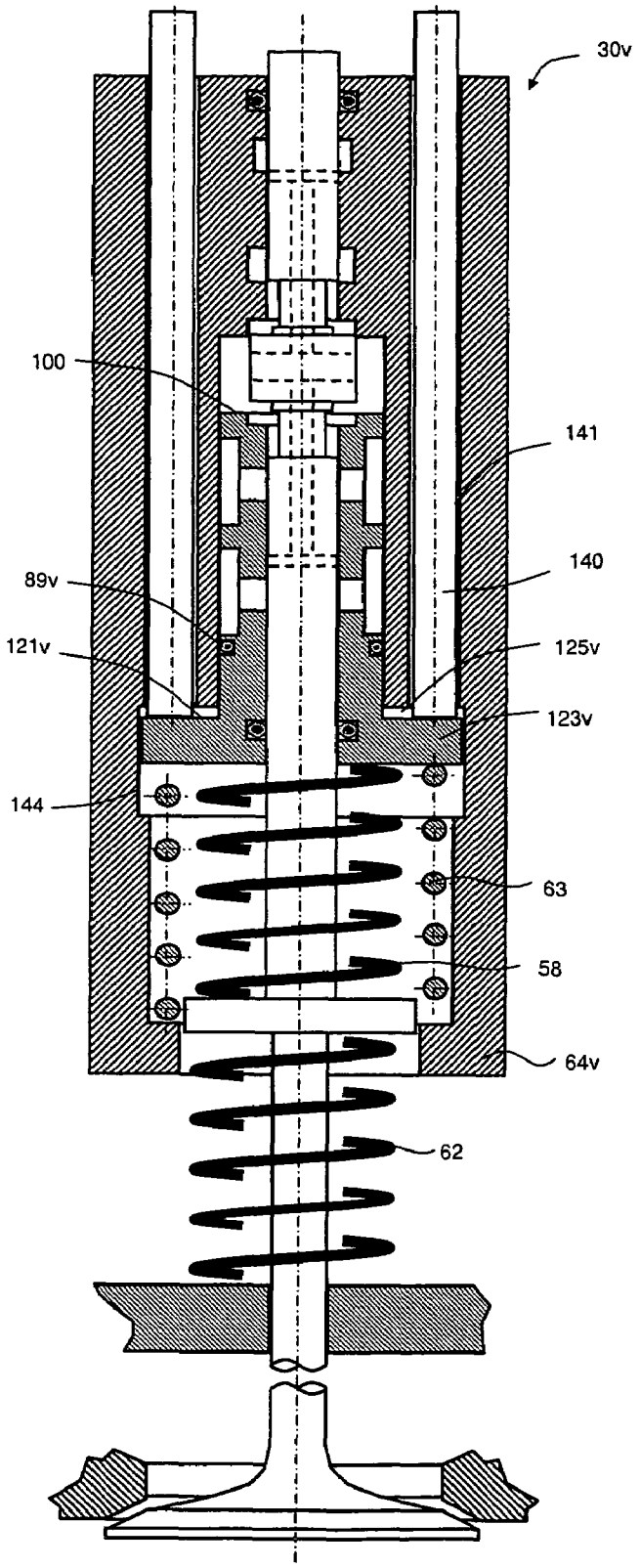
FIG. 11 is a schematic illustration of another preferred embodiment which utilizes two pins to drive the stroke controller.

Refer now to FIG. 11, there is a drawing of another alternative embodiment of the invention. In this embodiment, the stroke controller 123*v* is controlled via one or more pins 140, which is further driven by a mechanical means (not shown in FIG. 11), e.g. a cam or a sliding wedge. The pins 140 can either be rigidly connected to or make a simple mechanical contact with the stroke controller 123*v*. If it is a simple mechanical contact, the sum of the rest of the axial forces on the stroke controller 123*v* has to be in the first direction, which can be helped by the optional stroke spring 63 if not enough preload from the actuation spring 58. If additional force is needed in the second direction because of, for example, too much preload from the actuation spring 58, the chamber 125*v* can be pressurized like the stroke control chamber 125 in FIG. 1, with additional sealing consideration between the pins 140 and the holes 141. Otherwise, the chamber 125*v* is not pressurized by the strategic location of a seal 89*v* or generous radial clearances between the stroke controller 123*v* and the second cavity 144 and between the pins 140 and the holes 141 or a combination of both.

The pins 140 slideably run through pin holes 141 fabricated in the housing 64*v*. The pin holes 141 are not to interfere with the first and second ports 56 and 42 and associated flow channels as shown in FIG. 1 and are not necessarily placed in the same physical plane(s) as those ports 56 and 42 and channels. That is why the second ports 56 and 42 and associated flow channels are not illustrated in FIG. 11, which does not exclude their existence that is implicit for proper functions of the actuator 30*v*.

If space allows and as another option, the pins 140 can be arranged, not shown in the figures, to push or be mechanically connected to the bypass second edge 100, instead of the stroke controller first surface 121*v*, resulting in shorter pins and holes 140 and 141.

For all stroke control mechanisms disclosed above and implied otherwise, the speed of control should be appropriately regulated so that the stroke variation within a single valve switch operation is not large enough to disrupt the pendulum operation of the actuators. Coupled with frictional losses and the need to overcome engine cylinder air pressure, a large stroke increase of a distance of L2 or more in the valve opening stroke, for example, may prevent the actuation piston 46 reaches the second partial cylinder 115 as shown in FIG. 1, resulting in a latching failure, because the potential energy stored in the springs at the initial time of a shorter stroke is not enough, after an intermediate step as the kinetic energy, to compress the spring to a longer distance at the later time, possible even with hydraulic energy addition in the first partial cylinder 114. On the other hand, a large stroke reduction during a stroke may present extra energy for the snubbing mechanism to handle at the end of the stroke, causing unnecessary heavy metal impact, additional stress and unusual noises.

Figure 12:
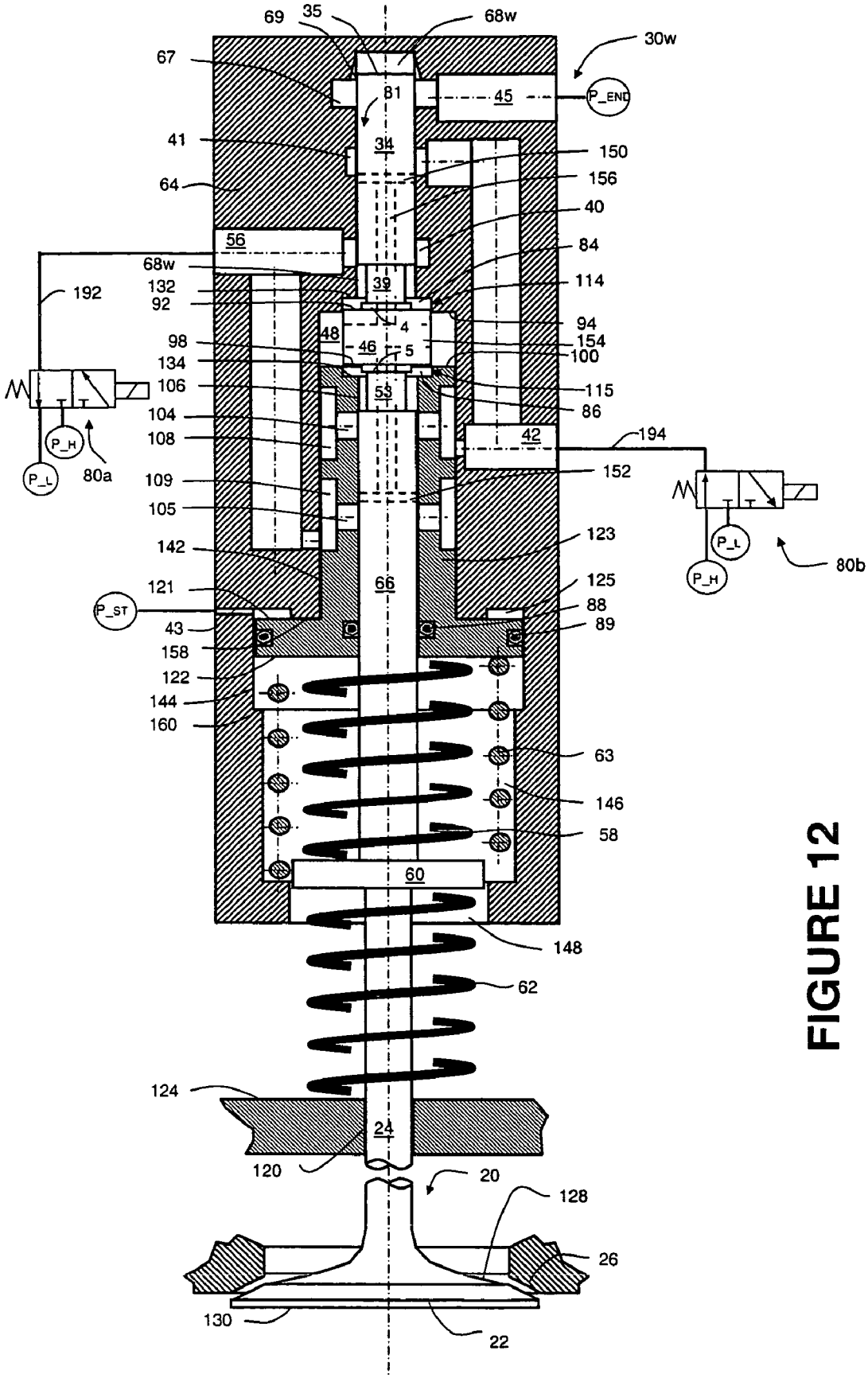
FIG. 12 is a schematic illustration of another preferred embodiment which has another snubbing mechanism and uses two 3-way switch valves, instead of one 4-way switch valve.

Refer now to FIG. 12, there is a drawing of another alternative embodiment of the invention. This embodiment is different from that in FIG. 1 primarily in its structure in the first direction end. Instead of letting it pump in the air, the first piston rod first end 35 is now immersed in the fluid in the enclosed first bore 68*w*, which is supplied through a fourth port 45 and a first end groove 67 by a fluid supply at a pressure of P_END. The first end groove is so located longitudinally that when the engine valve 20 is near the end of its closing travel, some fluid is trapped at the end of the first bore 68W and can escape only through one or more notches 69 on the wall of the first bore 68W, resulting in a snubbing action to help the engine valve 20 achieve its soft landing or impact on the valve seat 26. This snubbing mechanism can either complement or replace the snubbing function achieved by the first shoulder 44 in the engine valve closing moment, when the speed reduction is more critical than the engine valve opening moment. The details of the snubbing mechanism, i.e., the notches 69 and the first end groove 67, are for illustration purpose only. The snubbing function can also be achieved by other known means, e.g. replacing the notches 69 with a particular radial clearance pattern between the first piston rod 34 and the first bore 68W near the first direction end.

With the capped first bore 68W, the first piston rod first end 35 also pumps the fluid during the rest of the opening and closing strokes and experiences a hydraulic pressure force in the second direction, the magnitude of which depends on the P_END value. This hydraulic pressure force helps the engine valve 20 overcome the air cylinder pressure during the opening stroke and resists the engine valve 20 during the closing, which is not too bad considering more favorable air pressure on the engine valve 20 during the closing. With the proper selection of the P_END value, this pumping action of the fluid is added advantage in balancing overall force and energy needs during opening and closing strokes. Ideally, the P_END value should be equal to the P_L value to save a pressure control device. Also with the capped first bore 68W, a potential external leakage site is eliminated.

Refer now to FIG. 13, there is a drawing of another alternative embodiment of the invention. This embodiment includes an end switch valve 82*a* or 82*b*, which can be arranged in two different ways as shown in FIG. 13*a* and 13*b*, respectively. The rest of the actuator is identical to those in FIG. 12 and is therefore omitted in the illustration. In FIG. 13*a*, the end switch valve 82*a* is used to connect the fourth port 45 either to the fluid supply P_END when the valve 82*a* is its left position or to the fluid line 192 when the valve 82*a* is at its right position. The fluid supply P_END is very similar to those described in FIG. 12 and is for normal valve operations like opening and closing during normal combustion cycles. When the fourth port 45 is connected to the fluid line 192, which normally carries the fluid alternating between pressure values of P_H and P_L, the first piston rod first end experiences a high hydraulic force during the entire period of a valve opening stroke and a very small hydraulic force during the closing period. This adds a big boost to the valve opening effort, which can be fruitfully utilized for compression braking used in large trucks and high-cylinder-air-pressure valve operations in air hybrid vehicle. In FIG. 13*a*, the end switch valve 82*a* is switched only for the mode change from a normal operation to, say, a compression braking operation and vice versa. The actuation switch valve or valves, which supply the fluid line 192 and are not shown in FIG. 13*a*, do the fast switching for each engine valve stroke.

In FIG. 13*b*, the end switch valve 82*b* is used to connect the fourth port 45 either to the fluid at pressure P_El or to the fluid pressure P_E2. The pressures P_E1 and P_E2 are a lower and a higher pressure, respectively. Ideally, P_E1 and P_E2 are equal to P_L and P_H, respectively. During normal valve opening and closing operations, the end switch valve 82*b* stays at its left position, and the actuator 30*w* works like that in FIG. 12. During compression braking or other high air cylinder pressure operations, the end switch valve 82*b* is switched at the same frequency as that of the actuation switch valve, not shown here, to keep the boost force on the first piston rod first end in sync with that on the actuation piston, not shown here. In this case, the extent of the boost can be regulated by varying the time period when the end switch valve 82*b* is in its right position.

The actuation switch valve 80 in FIGS. 1-11 is used for the illustration purpose only and should not be considered to be the only valve type that can be used. For example, it may be replaced by a two 2-position 3-way valves 80*a* and 80*b*, each of which being able to control one of the two fluid lines 192 and 194 for its connection with the high pressure P_H and low pressure P_L lines as shown in FIG. 12. In general, a 3-way valve is easier to manufacture than a 4-way valve.

One can purposely introduce a time delay between the actions of the two actuation switch valves 80*a* and 80*b* for certain functions. During the engine valve opening operation, for example, one can reduce the hydraulic energy input at the beginning of the stroke by delaying the switch of the valve 80*a* and thus keeping the first fluid space 84 at low pressure P_L a little bit longer, which may be desirable if the engine air cylinder pressure is expected to be low. Also, the switch valve 80 may be controlled by two, instead of one, solenoids, with or without return spring(s).

Although in many illustrations, there is one actuation switch valve for each hydraulic actuator or engine valve, this need not be the case. As many modern engines have two intake and/or two exhaust valves per engine cylinder, one actuation switch valve may simultaneously control two intake or exhaust valves on the same engine cylinder if the control strategy does not call for asymmetric opening.

Also in many illustrations and descriptions, the fluid medium is defaulted to be hydraulic or of liquid form. In most cases, the same concepts can be applied with proper scaling to pneumatic actuators and systems. As such, the term "fluid" as used herein is meant to include both liquids and gases. Also in many illustrations and descriptions so far, the application of the hydraulic actuator 30 is defaulted to be in engine valve control, and it is not limited so. The hydraulic actuator 30 can be applied to other situations where a fast and/or energy efficient control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. An actuator, comprising:

a housing having first and second fluid ports;

a stroke controller slideably disposed in the housing;

first and second partial cylinders in the housing and the stroke controller, respectively, defining a longitudinal axis and having cylinder first and second ends in first and second directions, respectively;

an actuation piston disposed between the first and second partial cylinders, the actuation piston having first and second surfaces moveable along the longitudinal axis;

first and second actuation springs biasing the actuation piston in the first and second directions, respectively;

a first fluid space defined by the cylinder first end and the first surface of the actuation piston;

a second fluid space defined by the cylinder second end and the second surface of the actuation piston;

a fluid bypass that short-circuits the first and second fluid spaces when the actuation piston does not overlap either of the first and second partial cylinders;

a first flow mechanism in fluid communication between the first fluid space and the first port;

a second flow mechanism in fluid communication between the second fluid space and the second port;

a first supplemental flow mechanism in fluid communication between the first fluid space and the first port; and a second supplemental flow mechanism in fluid communication between the second fluid space and the second port.

2. The actuator of claim 1, wherein the first, second, first-supplemental and second-supplemental flow mechanisms include a variable metering capability.

3. The actuator of claim 1, wherein:

each of the first, second, first supplemental and second supplemental flow mechanisms is at least partially closed when the actuation piston does not overlap either of the first and second partial cylinders, such that the fluid bypass is substantially open;

each of the first and second-supplemental flow mechanisms is at least partially open when the actuation piston overlaps the first partial cylinder and thus, such that the fluid bypass is substantially closed; and each of the second and first-supplemental flow mechanisms is at least partially open when the actuation piston overlaps the second partial cylinder and thus, such that the fluid bypass is substantially closed.

4. The actuator of claim 1, further comprising:

a first piston rod having an outside dimension connected to the first surface of the actuation piston via a first neck having an outside dimension;

a first bore to, and in fluid communication with, the first fluid space, the first bore having an inside dimension distally in the first direction;

a first chamber including one or more undercuts in fluid communication with the first port and the first bore;

a second piston rod having an outside dimension connected to the second surface of the actuation piston via a second neck having an outside dimension;

a second bore to, and in fluid communication with, the second fluid space, the second bore having an inside dimension inside the stroke controller distally in the second direction;

a second chamber in fluid communication with the second bore, the second chamber including one or more undercuts inside the stroke controller;

a first groove situated between, and in fluid communication with, the second chamber and the second port, independent of the longitudinal location of the stroke controller;

the first flow mechanism comprising the first neck, the first piston rod, the first bore, and the first chamber;

the second flow mechanism comprising the second neck, the second piston rod, the second bore, and the second chamber;

the inside dimension of the first bore being slightly larger than the outside dimension of the first piston rod and substantially larger than the outside dimension of the first neck, such that the first piston rod blocks fluid communication between the first bore and the first chamber and closes the first flow mechanism when the actuation piston does not overlaps the first partial cylinder;

the inside dimension of the second control bore being slightly larger than the outside dimension of the second rod and substantially larger than the outside dimension of the second neck, such that the second piston rod blocks fluid communication between the second bore and the second chamber and closes the second flow mechanism when the actuation piston does not overlaps the second partial cylinder;

first and second rod passages traversing the first and second piston rods, respectively, in fluid communication with the fluid bypass via one or more center passages longitudinally inside the first and second piston rods, the first and second necks and the actuation piston and one or more piston passages traversing the actuation piston;

a second-supplemental chamber in fluid communication with the second port including one or more undercuts around the first bore further distal, in the first direction, to the first chamber;

a first supplemental chamber is one or more undercuts around the second bore, further distal, in the second direction, to the second chamber;

a second groove is one or more undercuts situated between and in fluid communication with the first port and the first-supplemental chamber, independent of the longitudinal location of the stroke controller;

the first supplemental flow mechanism comprising the second groove, the first-supplemental chamber, the second rod passage, the center passage, the piston passage and the fluid bypass;

the second-supplemental flow mechanism comprising the second-supplemental chamber, the first rod passage, the center passage, the piston passage and the fluid bypass;

wherein the first-supplemental flow mechanism is opened when the second rod passage at least partially overlaps the first-supplemental chamber, which occurs when the actuation piston overlaps the second partial cylinder; and wherein the second-supplemental flow mechanism is opened when the first rod passage at least partially overlaps the second-supplemental chamber, which occurs when the actuation piston overlaps the first partial cylinder.

5. The actuator of claim 4, wherein:

the first and second actuation springs are compression springs in serial arrangement;

a spring seat is fixed to the second piston rod and is distal to a stroke controller second surface;

the second actuation spring is supported at its two ends by the stroke controller second surface and the spring seat;

the first actuation spring is supported at its two ends by the spring seat and a spatially fixed surface further distal to the spring seat in the second direction; and whereby a neutral position, defined as a position where the net spring force on the spring seat is zero, of the shaft assembly moves with the stroke controller along the longitudinal axis, with the shaft assembly defined an assembly of the actuation piston and attached elements including the first and second piston rods, the first and second necks and the spring seat.

6. The actuator of claim 5, further including a stroke spring, urged against the second stroke surface in the first direction.

7. The actuator of claim 4, wherein the first direction end of the first bore is closed and works in conjunction with the first direction end of the first rod to substantially trap the fluid when travel approaches the cylinder first end, thereby exerting a snubbing force to the first rod.

8. The actuator of claim 4, further including a first shoulder longitudinally situated between the first neck and the first surface of the actuation piston and a second shoulder longitudinally situated between the second neck and the second surface of the actuation piston, the first shoulder having an outer dimension that is smaller than the inside dimension of the first bore yet sufficiently large to generate a substantial flow restriction or snubbing action when the first shoulder overlaps longitudinally the first bore; and the second shoulder having an outer dimension that is smaller than the inside dimension of the second bore yet sufficiently large to generate a substantial flow restriction or snubbing action when the second shoulder overlaps longitudinally the second bore.

9. The actuator of claim 4, wherein the first direction end of the first bore is supplied with the fluid under a desired pressure, such that additional hydraulic force on the first directional end of the first rod assists in driving the actuator in the second direction.

10. The actuator of claim 4, wherein the first direction end of the first bore is supplied with the fluid through one or more switch valves, thereby exposing it to a low pressure during one mode of operation and to alternating low and high pressure during another mode of operation.

11. The actuator of claim 1, wherein the stroke controller is slideably disposed in a first cavity in the housing, the first cavity has an inside dimension larger than the outside dimension of the actuation piston, and the fluid bypass is an annular passage between the first cavity and the actuation piston in radial direction and between the first and second partial cylinders longitudinally.

12. The actuator of claim 1, wherein the stroke controller forms, in conjunction with the housing, a stroke control chamber, which is filled with a control fluid through a third fluid port, thereby exerting a fluid force on the stroke controller along the longitudinal axis.

13. The actuator of claim 12, further including a stroke spring, pushing against the second stroke surface in the first direction.

14. The actuator of claim 1, wherein the longitudinal position of the stroke controller is controlled by a mechanical mechanism.

15. The actuator of claim 14, wherein the mechanical mechanism is one or more sets of racks and pinions.

16. The actuator of claim 14, further including one or more pins, which are in direct contact with the stroke controller and through which the mechanical mechanism controls the position of the stroke controller.

17. The actuator of claim 1, further including one or more snubbers to dampen the speed of the actuation piston when travel approaches either the cylinder first or second ends.

18. The actuator of claim 1, further including a four-way actuation switch valve to supply the first and second ports with high- and low-pressure fluid to drive the actuation piston in the first and second directions.

19. The actuator of claim 1, further including two three-way actuation switch valves, each of which alternately supplies one of the first and second ports with high- and low-pressure fluid.

20. The actuator of claim 1, further comprising:

a first piston rod having an outside dimension is connected to the first surface of the actuation piston via a first neck having an outside dimension;

a first bore having an inside dimension distally in the first direction, to and in fluid communication with, the first fluid space;

a first chamber having one or more undercuts in fluid communication with the first port and the first bore;

a second piston rod having an outside dimension, the second piston rod being connected to the second surface of the actuation piston via a second neck having an outside dimension;

a second bore having an inside dimension inside the stroke controller distally in the second direction, to and in fluid communication with, the second fluid space;

a second chamber having one or more undercuts inside the stroke controller, the second chamber being in fluid communication with the second bore;

a first groove including one or more undercuts situated between, and in fluid communication with, the second port and the second chamber, independent of the longitudinal location of the stroke controller;

the first flow mechanism includes the first neck, the first piston rod, the first bore, and the first chamber;

the second flow mechanism includes the second neck, the second piston rod, the second bore, and the second chamber;

the inside dimension of the first bore being slightly larger than the outside dimension of the first piston rod and substantially larger than the outside dimension of the first neck, the first piston rod acting to block fluid communication between the first bore and the first chamber, thereby closing the first flow mechanism when the actuation piston does not overlaps the first partial cylinder;

the inside dimension of the second control bore being slightly larger than the outside dimension of the second rod and substantially larger than the outside dimension of the second neck, the second piston rod acting to block fluid communication between the second bore and the second chamber, thereby closing the second flow mechanism when the actuation piston does not overlap with the second partial cylinder;

first and second rod passages including undercuts along at least a portion of the length of on the first and second piston rods, respectively, enabling longitudinal flow communication over the length of the undercuts, through the open space between the first bore and the first rod and between the second bore and the second rod;

a second supplemental chamber in fluid communication with the second port including one or more undercuts around the first bore further distally in the first direction relative to the first chamber;

a first supplemental chamber including one or more undercuts around the second bore further distally in the second direction relative to the second chamber;

a second groove including one or more undercuts situated between, and in fluid communication with, the first port and the first supplemental chamber, independent of the longitudinal location of the stroke controller;

a first supplemental chamber extension is one or more undercuts inside and around the second bore proximate to the first-supplemental chamber;

a second supplemental chamber extension is one or more undercuts inside and around the first bore proximate to the second supplemental chamber, a third groove including one or more undercuts connected to, and in fluid communication with, the first supplemental chamber extension;

a fluid communication channel or network extending through the housing, in direct fluid communication with the second supplemental chamber extension and the fluid bypass, and with the first supplemental chamber extension through the third groove;

the first-supplemental flow mechanism includes the second groove, the first-supplemental chamber, the second rod passage, the first-supplemental chamber extension, the fluid communication channel, and the fluid bypass;

the second-supplemental flow mechanism includes the second-supplemental chamber, the first rod passage, the second-supplemental chamber extension, the fluid communication channel and the fluid bypass;

the first supplemental flow mechanism is opened when the second rod passage at least partially overlaps both the first-supplemental chamber and the first supplemental chamber extension, which occurs when the actuation piston overlaps the second partial cylinder; and the second supplemental flow mechanism is opened when the first rod passage at least partially overlaps both the second-supplemental chamber and the second-supplemental chamber extension, which occurs when the actuation piston overlaps the first partial cylinder.

21. The actuator of claim 1, further comprising:

a first piston rod having an outside dimension connected to the first surface of the actuation piston via a first neck having an outside dimension;

a first bore having an inside dimension distally, in the first direction, to and in fluid communication with the first fluid space;

a first chamber including one or more undercuts in fluid communication with the first port and the first bore;

a second piston rod having an outside dimension connected to the second surface of the actuation piston via a second neck having an outside dimension;

a second bore having an inside dimension inside the stroke controller and distally, in the second direction, to and in fluid communication with the second fluid space;

a second chamber including one or more undercuts inside the stroke controller, in fluid communication with the second bore;

a first groove including one or more undercuts situated between, and in fluid communication with, the second port and the second chamber, independent of the longitudinal location of the stroke controller;

the first flow mechanism including the first neck, the first piston rod, the first bore, and the first chamber;

the second flow mechanism including the second neck, the second piston rod, the second bore, and the second chamber;

the inside dimension of the first bore being slightly larger than the outside dimension of the first piston rod and substantially larger than the outside dimension of the first neck, the first piston rod acting to block fluid communication between the first bore and the first chamber, thereby closing the first flow mechanism when the actuation piston does not overlaps the first partial cylinder;

the inside dimension of the second control bore being slightly larger than the outside dimension of the second rod and substantially larger than the outside dimension of the second neck, the second piston rod acting to block fluid communication between the second bore and the second chamber, thereby closing the second flow mechanism when the actuation piston does not overlaps the second partial cylinder;

first and second rod passages including undercuts along at least a portion of the length of on the first and second piston rods respectively, allowing longitudinal flow communication over the length of the undercuts through the open space between the first bore and the first rod and between the second bore and the second rod;

a second supplemental chamber in fluid communication with the second port including one or more undercuts around the first bore further distally in the first direction relative to the first chamber;

a first supplemental chamber including one or more undercuts wound the second bore, further distally in the second direction relative to the second chamber;

a second groove including one or more undercuts situated between, and in fluid communication with, the first port and the first-supplemental chamber, independent of the longitudinal location of the stroke controller;

a first supplemental chamber extension including one or more undercuts inside and around the second bore and proximate to the first-supplemental chamber;

a second supplemental chamber extension including one or more undercuts inside and around the first bore and proximate to the second-supplemental chamber, a third groove including one or more undercuts connected to, and in fluid communication with, the first-supplemental chamber extension;

a first supplemental channel in the stroke controller and in fluid communication with the fluid bypass and the first-supplemental chamber extension;

a second supplemental channel in the housing and in fluid communication with the fluid bypass and the second-supplemental chamber extension;

the first supplemental flow mechanism including the second groove, the first supplemental chamber, second rod passage, first supplemental chamber extension, first supplemental channel, and the fluid bypass;

the second supplemental flow mechanism including the second supplemental chamber, first rod passage, second supplemental chamber extension, second supplemental channel, and the fluid bypass;

the first-supplemental flow mechanism being opened when the second rod passage at least partially overlaps both the first supplemental chamber and first supplemental chamber extension, which occurs when the actuation piston overlaps the second partial cylinder; and the second supplemental flow mechanism being opened when the first rod passage at least partially overlaps both the second supplemental chamber and second supplemental chamber extension, which occurs when the actuation piston overlaps the first partial cylinder.

22. An engine air exchange regulator, comprising:

a housing having first and second fluid ports;

a stroke controller slideably disposed in the housing;

first and second partial cylinders in the housing and the stroke controller, respectively, defining a longitudinal axis and having cylinder first and second ends in first and second directions, respectively;

an actuation piston disposed between the first and second partial cylinders with first and second surfaces moveable along the longitudinal axis;

first and second actuation springs biasing the actuation piston in the first and second directions, respectively;

a first fluid space defined by the cylinder first end and the first surface of the actuation piston;

a second fluid space defined by the cylinder second end and the second surface of the actuation piston;

a fluid bypass that short-circuits the first and second fluid spaces when the actuation piston does not overlap either of the first and second partial cylinders;

a first piston rod having an outside dimension and a first neck having an outside dimension, the first piston rod being connected to the first surface of the actuation piston via the first neck;

a first bore having an inside dimension distally in the first direction to, and in fluid communication with, the first fluid space;

a first chamber, which is one or more undercuts in fluid communication with the first port and the first bore;

a second piston rod having an outside dimension and a second neck having an outside dimension, with the second piston rod being connected to the second surface of the actuation piston via the second neck;

a second bore having an inside dimension and being inside the stroke controller distally in the second direction to, and in fluid communication with, the second fluid space;

a second chamber, which is one or more undercuts inside the stroke controller, in fluid communication with the second bore;

a first groove, which is one or more undercuts, situated between and in fluid communication with the second port and the second chamber, independent of the longitudinal location of the stroke controller;

first and second rod passages traversing the first and second piston rods respectively, the rod passages being in fluid communication the fluid bypass via one or more center passages longitudinally inside the first and second piston rods, the first and second necks and the actuation piston and one or more piston passages traversing the actuation piston;

a second-supplemental chamber, which is one or more undercuts around the first bore further distal, in the first direction, to the first chamber, in fluid communication with the second port;

a first-supplemental chamber, which is one or more undercuts around the second bore, further distal, in the second direction, to the second chamber;

a second groove, which is one or more undercuts, situated between and in fluid communication with the first port and the first-supplemental chamber, independent of the longitudinal location of the stroke controller;

a first flow mechanism including the first neck, the first piston rod, the first bore, and the first chamber, whereby controlling fluid communication between the first fluid space and the first port;

a second flow mechanism including the second neck, the second piston rod, the second bore, and the second chamber, whereby controlling fluid communication between the second fluid space and the second port;

a first-supplemental flow mechanism including the second groove, the first-supplemental chamber, the second rod passage, the center passage, the piston passage and the fluid bypass, whereby controlling fluid communication between the first fluid space and the first port;

a second-supplemental flow mechanism including the second-supplemental chamber, the first rod passage, the center passage, the piston passage and the fluid bypass, whereby controlling fluid communication between the second fluid space and the second port;

one or more snubbers, whereby the speed of the actuation piston is substantially damped when the piston travels approaching either of the cylinder first and second ends; and an engine valve operably connected to the second piston rod, and wherein:

the inside dimension of the first bore is slightly larger than the outside dimension of the first piston rod and substantially larger than the outside dimension of the first neck, and the first piston rod blocks fluid communication between the first bore and the first chamber and closes the first flow mechanism when the actuation piston does not overlaps the first partial cylinder;

the inside dimension of the second control bore is slightly larger than the outside dimension of the second rod and substantially larger tan the outside dimension of the second neck, and the second piston rod blocks fluid communication between the second bore and the second chamber and thus closes the second flow mechanism when the actuation piston does not overlaps the second partial cylinder;

the first-supplemental flow mechanism is opened when the second rod passage at least partially overlaps the first-supplemental chamber, which happens when the actuation piston overlaps the second partial cylinder; and the second-supplemental flow mechanism is opened when the first rod passage at least partially overlaps the second-supplemental chamber, which happens when the actuation piston overlaps the first partial cylinder.

23. The engine air exchange regulator of claim 22, wherein:

the first and second actuation springs are compression springs in serial arrangement;

a spring seat is fixed to the second piston rod and is distal to a stroke controller second surface;

the second actuation spring is supported at its two ends by the stroke controller second surface and the spring seat;

the first actuation spring is supported at its two ends by the spring seat and a spatially fixed surface further distal to the spring seat in the second direction; and in the neutral position, defined as a position where the net spring force on the spring seat is zero, the shaft assembly moves with the stroke controller along the longitudinal axis, with the shaft assembly defined an assembly of the actuation piston and attached elements including the first and second piston rods, the first and second necks and the spring seat.

24. The engine air exchange regulator of claim 22, further including a four-way actuation switch valve supplying the first and second ports with high-pressure and low-pressure fluid, respectively, to drive the actuation piston in the second direction and with low-pressure and high-pressure fluid, respectively, to drive the actuation piston in the first direction.

* * * * *

UNITED STATES PATENT AND TRADEMARK OFFICE

CERTIFICATE OF CORRECTION

PATENT NO. : 7,290,509 B2
APPLICATION NO. : 11/194243
DATED : November 6, 2007
INVENTOR(S) : Zheng Lou It is certified that error appears in the above-identified patent and that said Letters Patent is hereby corrected as shown below:

Title Page (76), replace “Felloes” with --Fellows--
Column 2, line 48, replace “inventers” with --inventors--
Column 2, line 54, replace “of the each” with --of each--
Column 3, line 15, replace “despite of the” with --despite the--
Column 5, line 65, replace “does not overlaps” with --does not overlap--
Column 6, line 4, replace “does not overlaps” with --does not overlap--
Column 9, line 53, replace “first part 56 through” with --first part 56.--
Column 11, line 60, replace “pressure happens decreases” with --pressure decreases--
Column 12, line 8, replace “never hits” with --never hit--
Column 14, line 39, replace “from of the flow” with --from the flow--
Column 14, line 58, replace “does not overlaps” with --does not overlap--
Column 16, line 50, replace “enough to time” with --enough time to--
Column 22, line 43, replace “does not overlaps” with --does not overlap--
Column 22, line 51, replace “does not overlaps” with --does not overlap--
Column 25, line 11, replace “does not overlaps” with --does not overlap--
Column 25, line 22, replace “of on the” with --of the--
Column 26, line 38, replace “does not overlaps” with --does not overlap--
Column 26, line 46, replace “does not overlaps” with --does not overlap--
Column 26, line 50, replace “of on the” with --of the--
Column 26, line 60, replace “undercuts wound” with --undercuts around--
Column 28, line 14, replace “communication the” with --communication with the--
Column 28, line 60, replace “does not overlaps” with --does not overlap--
Column 29, line 2, replace “does not overlaps” with --does not overlap--
Column 30, line 7, replace “defined an” with --defined as an--

Signed and Sealed this

Twenty-second Day of July, 2008

JON W. DUDAS
*Director of the United States Patent and Trademark Office*